US012305863B2

(12) United States Patent
Ye et al.

(10) Patent No.: US 12,305,863 B2
(45) Date of Patent: May 20, 2025

(54) COOKING DEVICE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Bin Ye, Foshan (CN); Dongdong Wang, Foshan (CN); Kelei Sun, Foshan (CN); Yanqing Deng, Foshan (CN); Shigang Zhang, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 807 days.

(21) Appl. No.: 17/560,279

(22) Filed: Dec. 23, 2021

(65) Prior Publication Data

US 2022/0205646 A1 Jun. 30, 2022

(30) Foreign Application Priority Data

Dec. 31, 2020 (CN) ..... 202011637910.2
Dec. 31, 2020 (CN) ..... 202011638777.2
(Continued)

(51) Int. Cl.
*F24C 15/20* (2006.01)
*F24C 7/02* (2006.01)
*F24C 15/30* (2006.01)

(52) U.S. Cl.
CPC ..... *F24C 15/2071* (2013.01); *F24C 7/02* (2013.01); *F24C 15/2042* (2013.01); *F24C 15/30* (2013.01)

(58) Field of Classification Search
CPC ... H05B 6/642; H05B 6/6408; F24C 15/2021; F24C 15/2035; F24C 15/20; F24C 15/30; F24C 15/2042; F24C 15/2071; F24C 7/02
See application file for complete search history.

(56) References Cited

U.S. PATENT DOCUMENTS 3,417,742 A 12/1968 Perl
4,453,690 A * 6/1984 Takeuji ..... A47B 95/008 248/309.1
(Continued)

FOREIGN PATENT DOCUMENTS

CN 1614317 A 5/2005
CN 101461614 A 6/2009
(Continued)

OTHER PUBLICATIONS

First OA mailed Sep. 5, 2022 of CN Application No. 202011640830.2.
(Continued)

*Primary Examiner* — Brian W Jennison

(57) ABSTRACT

The present disclosure belongs to the field of kitchen equipment, and in particular relates to a cooking device. The cooking device of the present disclosure includes a cabinet and an installation bracket. A cooking chamber is formed in the cabinet, and the installation bracket is detachably connected to the cabinet. A fan assembly is arranged on the installation bracket, and a fume exhaust duct that communicates with the fan assembly is arranged in the installation bracket or in the cabinet. According to the cooking device of the present disclosure, the cabinet and the fan assembly are arranged separately, the fan assembly is arranged on the installation bracket, and a fume exhaust duct that communicates with the fan assembly is arranged inside the installation bracket.

27 Claims, 11 Drawing Sheets

(30) Foreign Application Priority Data

Dec. 31, 2020 (CN) ..... 202011639467.2
Dec. 31, 2020 (CN) ..... 202011640830.2

(56) References Cited

U.S. PATENT DOCUMENTS

| | | | | |
|---|---|---|---|---|
| 4,824,061 | A * | 4/1989 | Sumikama | H05B 6/666 248/225.21 |
| 9,752,786 | B2 | 9/2017 | Armstrong et al. | |
| 10,578,311 | B2 | 3/2020 | Briscoe et al. | |
| 10,718,526 | B2 | 7/2020 | Neal et al. | |
| 2015/0257591 | A1 * | 9/2015 | Armstrong | F24C 15/2021 99/341 |

FOREIGN PATENT DOCUMENTS

| | | | |
|---|---|---|---|
| CN | 105402788 | A | 3/2016 |
| CN | 107894014 | A | 4/2018 |
| CN | 108497942 | A | 9/2018 |
| CN | 109442511 | A | 3/2019 |
| CN | 208967869 | U | 6/2019 |
| CN | 110542127 | A | 12/2019 |
| CN | 210511832 | U | 5/2020 |
| CN | 211066246 | U | 7/2020 |
| CN | 111878864 | A | 11/2020 |
| CN | 211854128 | U | 11/2020 |
| CN | 214370419 | U | 10/2021 |

OTHER PUBLICATIONS

First OA mailed Jul. 23. 2021 of CN Application No. 202011637910.2.

First OA mailed Sep. 5, 2022 of CN Application No. 202011638777.2.

First OA received in CN Application No. 202011639467.2; mailed Dec. 9, 2024.

* cited by examiner

COOKING DEVICE

CROSS-REFERENCES TO RELATED APPLICATIONS

The present application claims benefits of Chinese Application Nos. 202011638777.2, 202011639467.2, 202011637910.2, 202011639847.6, and 202011640830.2, filed with CNIPA on Dec. 31, 2020, the contents of which are hereby incorporated by reference in its entirety.

FIELD

The present disclosure belongs to the field of kitchen equipment, and in particular relates to a cooking device.

BACKGROUND

At present, the whole machine of an OTR (over-the-range) includes both functions of a microwave oven and a range hood. The weight of the whole machine is heavy, which is about 25 kg. The installation of OTR needs to be carried out by being hoisted on a kitchen cupboard. During the installation, an installation plate is fixed first on a kitchen cupboard wall, then the whole machine is lifted up to hang the back of the machine on the installation plate first, and then the rest of the installation process is completed. Due to the heavy weight of the OTR whole machine, the installation process is time-consuming and labor-consuming.

SUMMARY

An object of the present disclosure is to at least solve the problem of time-consuming and labor-consuming installation of an OTR device.

One embodiment of the present disclosure provides a cooking device, which includes:

a cabinet, in which a cooking chamber is formed; and an installation bracket detachably connected to the cabinet, a fan assembly being arranged on the installation bracket, and a fume exhaust duct that communicates with the fan assembly is arranged in the installation bracket or in the cabinet.

According to the cooking device of the present disclosure, the cabinet and the fan assembly are arranged separately, the fan assembly is arranged on the installation bracket, and a fume exhaust duct that communicates with the fan assembly is arranged inside the installation bracket. As compared with the prior art in which the fan assembly and the cabinet are of an integral structure, in the cooking device of this embodiment, the weight of the fan assembly is loaded on the installation bracket in advance, and the original total weight of the fan assembly and the cabinet are split into two parts, to relatively reduce the weight of the cabinet to be installed, which makes it easy to assemble the cabinet and the installation bracket, saves time and labor, effectively improves the installation efficiency of the cooking device, and improves customer satisfaction.

In addition, the cooking device according to the present disclosure may further have the following additional embodiments.

In some embodiments of the present disclosure, the installation bracket includes an installation back plate, and the installation back plate is arranged opposite to the cabinet.

In some embodiments of the present disclosure, the fan assembly is arranged above the installation back plate, and the fume exhaust duct is an intake passage.

In some embodiments of the present disclosure, the fan assembly includes a fan body and a fan housing, the fan body is arranged in the fan housing, the fan housing is provided with an installation sloping plate arranged toward the cabinet, and the cabinet is provided with an inclined plate arranged opposite to the installation sloping plate.

In some embodiments of the present disclosure, the fan assembly is arranged below the installation back plate, and the fume exhaust duct is an exhaust passage.

In some embodiments of the present disclosure, the fan assembly includes a fan body and a fan housing, the fan body is arranged in the fan housing, a bottom of the fan housing is provided with a first inclined surface, and a first intake port is provided on the first inclined surface.

In some embodiments of the present disclosure, the installation bracket further includes an installation bottom plate and an installation top plate, in which the installation bottom plate and the installation top plate are respectively connected with a bottom and a top of the installation back plate, and the cabinet is inserted into an opening structure enclosed by the installation bottom plate, the installation back plate and the installation top plate.

In some embodiments of the present disclosure, the installation back plate includes a first installation back plate and a second installation back plate arranged opposite to each other, and the fume exhaust duct is formed between the first installation back plate and the second installation back plate.

In some embodiments of the present disclosure, one of the first installation back plate and the second installation back plate is provided with at least one bulge arranged toward the other of the first installation back plate and the second installation back plate.

In some embodiments of the present disclosure, the installation back plate is provided with at least one rib arranged toward the cabinet, and the fume exhaust duct is formed between the installation back plate and the cabinet.

In some embodiments of the present disclosure, the installation bracket includes an installation top plate, a first installation side plate, an installation bottom plate and a second installation side plate that are connected end to end in sequence, and the cabinet is inserted into an installation space enclosed by the installation top plate, the first installation side plate, the installation bottom plate and the second installation side plate.

In some embodiments of the present disclosure, the fume exhaust duct is provided in the first installation side plate and/or the second installation side plate.

In some embodiments of the present disclosure, the fan assembly is arranged at the top or bottom of the installation bracket, and communicates with the fume exhaust duct.

In some embodiments of the present disclosure, the bottom of the installation bracket is provided with a second intake port, and the second intake port communicates with the fume exhaust duct.

In some embodiments of the present disclosure, third intake ports are provided at edge positions on both sides of the bottom of the installation bracket respectively, and the third intake ports communicate with the fume exhaust duct.

In some embodiments of the present disclosure, each installation surface inside the installation bracket is substantially planar, and there is a smooth transition between the installation surfaces.

In some embodiments of the present disclosure, the cooking device further includes a first power supply line and a second power supply line, and the first power supply line and the second power supply line are respectively configured to supply power to the cabinet and the fan assembly.

Another embodiment of the present disclosure also provides a cooking device, which includes:

a cabinet, in which a cooking chamber is formed;

an installation bracket detachably connected to the cabinet, the installation bracket including an installation back plate, the installation back plate being arranged opposite to the cabinet, and an interior of the installation back plate being provided with a fume exhaust duct; and a fan assembly, which is connected to the cabinet or the installation bracket, and which communicates with the fume exhaust duct.

According to the cooking device of the present disclosure, by arranging the fume exhaust duct in the interior of the installation back plate and it is isolated from the various components in the cabinet, a flow resistance during the fume exhaust process can be effectively reduced, a fume exhaust speed can be increased, and the fume exhaust effect can be ensured; moreover, there will be no damage caused to various components in the cabinet in the long-term fume exhaust process, a reliable operation of each component is ensured, and the service life of the cooking device is improved.

In some embodiments of the present disclosure, the installation back plate includes a first installation back plate and a second installation back plate arranged opposite to each other, and the fume exhaust duct is formed between the first installation back plate and the second installation back plate.

In some embodiments of the present disclosure, one of the first installation back plate and the second installation back plate is provided with at least one bulge arranged toward the other of the first installation back plate and the second installation back plate.

In some embodiments of the present disclosure, the installation back plate is provided with at least one rib arranged toward the cabinet, and the fume exhaust duct is formed between the installation back plate and the cabinet.

In some embodiments of the present disclosure, the fan assembly is arranged below the installation back plate, and the fan assembly includes a fan body and a fan housing, in which the fan body is arranged in the fan housing, a bottom of the fan housing is provided with a first inclined surface, and a first intake port is provided on the first inclined surface.

In some embodiments of the present disclosure, the fan assembly is arranged above the installation back plate, and the fan assembly includes a fan body and a fan housing, in which the fan body is arranged inside the fan housing, the fan housing is provided with an installation sloping plate arranged toward the cabinet, and the cabinet is provided with an inclined plate arranged opposite to the installation sloping plate.

In some embodiments of the present disclosure, the installation bracket further includes an installation bottom plate, which is connected to the bottom of the installation back plate, and the installation bottom plate is provided with a second intake port that communicates with the fume exhaust duct.

In some embodiments of the present disclosure, a cross-sectional shape of the second intake port is a bell mouth shape.

In some embodiments of the present disclosure, a flow guide plate is further provided on the installation bottom plate, and the flow guide plate is rotatably arranged at the second intake port.

In some embodiments of the present disclosure, the installation bracket further includes an installation top plate, which is connected to the top of the installation back plate, and the cabinet is inserted into an opening structure enclosed by the installation bottom plate, the installation back plate and the installation top plate.

Another embodiment of the present disclosure also provides a cooking device, which includes:

a cabinet, in which a cooking chamber is formed; and an installation bracket detachably connected with the cabinet; and a fan assembly, which is arranged below the cabinet or the installation bracket, a fume exhaust duct being arranged in the cabinet or in the installation bracket.

According to the cooking device of the present disclosure, by arranging the fan below the cabinet or the installation bracket, the space between the installation bracket and the stove can be effectively utilized and the space utilization is improved; at the same time, the space occupation of the fan assembly in the installation bracket can also be effectively reduced, to correspondingly increase the volume of the cooking chamber in the cabinet, increasing a storage space of the food in the cooking chamber, and further improving the cooking efficiency of the cooking device.

In some embodiments of the present disclosure, the fan assembly includes a fan body and a fan housing, the fan body is arranged in the fan housing, and the fan housing is connected with the cabinet or the installation bracket; a bottom of the fan housing is provided with a first inclined surface, and the first inclined surface is provided with a first intake port that communicates with the fume exhaust duct.

In some embodiments of the present disclosure, the installation bracket includes an installation back plate which is arranged opposite to the cabinet, the cabinet is connected with the installation back plate, and the fan assembly is arranged below the installation back plate or the cabinet.

In some embodiments of the present disclosure, the installation back plate is provided with at least one rib arranged toward the cabinet, and the fume exhaust duct is formed between the installation back plate and the cabinet.

In some embodiments of the present disclosure, the installation back plate includes a first installation back plate and a second installation back plate arranged opposite to each other, and the fume exhaust duct is formed between the first installation back plate and the second installation back plate.

In some embodiments of the present disclosure, one of the first installation back plate and the second installation back plate is provided with at least one bulge arranged toward the other of the first installation back plate and the second installation back plate.

In some embodiments of the present disclosure, the installation bracket includes an installation top plate, a first installation side plate, an installation bottom plate and a second installation side plate that are connected end to end in sequence, the cabinet is inserted into an installation space enclosed by the installation top plate, the first installation side plate, the installation bottom plate and the second installation side plate, and the fan assembly is arranged below the installation bottom plate.

In some embodiments of the present disclosure, the fume exhaust duct is provided in the first installation side plate and/or the second installation side plate.

In some embodiments of the present disclosure, each installation surface inside the installation top plate, the first installation side plate, the installation bottom plate and the second installation side plate is substantially planar, and there is a smooth transition between the installation surfaces.

In some embodiments of the present disclosure, the cooking device includes a first power supply line and a second power supply line, and the first power supply line and the second power supply line are respectively configured to supply power to the cabinet and the fan assembly.

Another embodiment of the present disclosure also provides a cooking device, which includes:

a cabinet, in which a cooking chamber is formed; and an installation bracket detachably connected to the cabinet, the installation bracket including an installation top plate, a first installation side plate, an installation bottom plate and a second installation side plate which are connected end to end in sequence, the cabinet being inserted into an installation space enclosed by the installation top plate, the first installation side plate, the installation bottom plate and the second installation side plate, and a fume exhaust duct being arranged in the first installation side plate and/or the second installation side plate.

According to the cooking device of the present disclosure, by arranging the fume exhaust duct inside the first installation side plate and/or the second installation side plate and oil fume is isolated from the various components in the cabinet, a flow resistance during the fume exhaust process can be effectively reduced, a fume exhaust speed can be increased, and the fume exhaust effect can be ensured; moreover, there will be no damage caused to various components in the cabinet in the long-term fume exhaust process, a reliable operation of each component in the cabinet is ensured, and the service life of the cooking device is improved.

In some embodiments of the present disclosure, the cooking device further includes at least one fan assembly, which is arranged on the cabinet and communicates with the fume exhaust duct.

In some embodiments of the present disclosure, the cooking device further includes at least one fan assembly, which is arranged on the installation bracket and communicates with the fume exhaust duct.

In some embodiments of the present disclosure, the fan assembly is arranged below the installation bracket, and the fan assembly includes a fan body and a fan housing, in which the fan body is arranged inside the fan housing, a bottom of the fan housing is provided with a first inclined surface, and a first intake port is arranged on the first inclined surface.

In some embodiments of the present disclosure, the fan assembly is arranged above the installation bracket, and the fan assembly includes a fan body and a fan housing, in which the fan body is arranged inside the fan housing, the fan housing is provided with an installation sloping plate arranged toward the cabinet, and the cabinet is provided with an inclined plate arranged opposite to the installation sloping plate.

In some embodiments of the present disclosure, a second intake port is arranged on the installation bottom plate, and the second intake port communicates with the fume exhaust duct.

In some embodiments of the present disclosure, a cross-sectional shape of the second intake port is a bell mouth shape.

In some embodiments of the present disclosure, a flow guide plate is further provided on the installation bottom plate, and the flow guide plate is rotatably arranged at the second intake port.

In some embodiments of the present disclosure, third intake ports are provided at edge positions on both sides of the bottom of the installation bracket, and the third intake ports communicate with the fume exhaust duct.

In some embodiments of the present disclosure, each installation surface inside the installation bracket is substantially planar, and there is a smooth transition between the installation surfaces.

BRIEF DESCRIPTION OF THE DRAWINGS

Upon reading the detailed description of the embodiments below, various other advantages and benefits will become clear. The accompanying drawings are only used for the purpose of illustrating embodiments, and should not be considered as a limitation to the present disclosure. Moreover, throughout the drawings, the same reference numerals are used to denote the same components, in which.

LIST OF REFERENCE SIGNS

Figure 1:
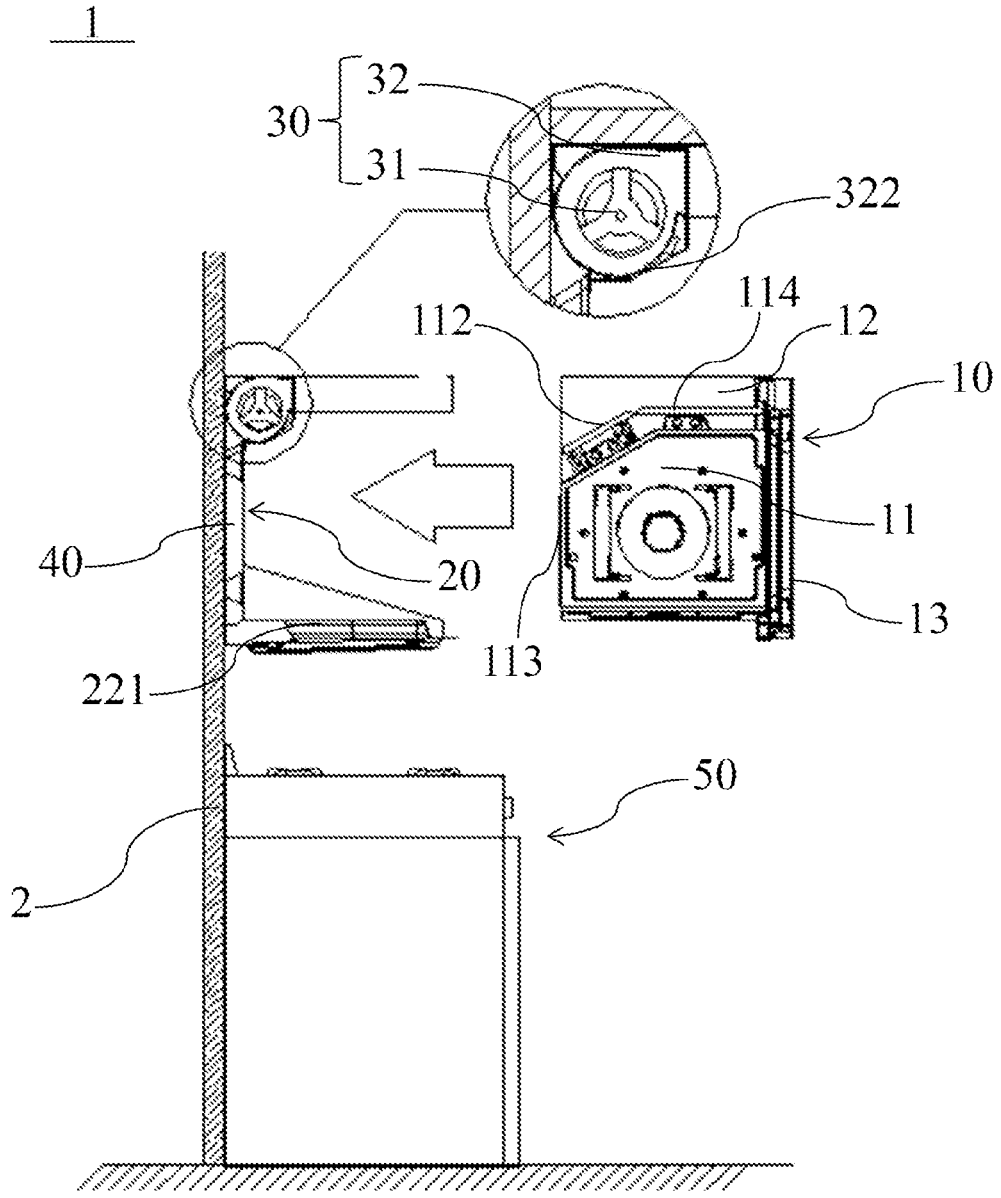
FIG. 1 is a schematic structural view of a cooking device with an installation bracket having a C-shaped structure according to the present disclosure before assembly.

1: cooking device;

10: cabinet; 11: inner cavity; 111: cooking chamber; 112: inclined plate; 1121: first plate body; 1122: second plate body; 113: rear side plate; 114: top plate; 12: casing; 13: door;

20: installation bracket; 21: installation back plate; 211: first installation back plate; 212: second installation back plate; 213: bulge; 214: rib; 22: installation bottom plate; 221: second intake port; 222: flow guide plate; 23: installation top plate; 24: first installation side plate; 25: second installation side plate;

30: fan assembly; 31: fan body; 311: first fan; 312: second fan; 32: fan housing; 321: first inclined surface; 322: installation sloping plate;

40: fume exhaust duct; 41: first fume exhaust duct; 42: second fume exhaust duct;

50: stove;

2: wall.

DETAILED DESCRIPTION OF THE DISCLOSURE

Hereinafter, exemplary embodiments of the present disclosure will be described in more detail with reference to the accompanying drawings. Although the exemplary embodiments of the present disclosure are shown in the drawings, it should be understood that the present disclosure may be implemented in various forms and should not be limited by the embodiments set forth herein.

It should be understood that the terms used herein are only for the purpose of describing specific exemplary embodiments, and are not intended to be limitative. Unless clearly indicated otherwise in the context, singular forms "a", "an", and "said" as used herein may also mean that plural forms are included. Terms "include", "comprise", "contain" and "have" are inclusive, and therefore indicate the existence of the stated features, steps, operations, elements and/or components, but do not exclude the existence or addition of one or more other features, steps, operations, elements, components, and/or combinations thereof. The method steps, processes, and operations described herein should not be interpreted as requiring them to be executed in the specific order described or illustrated, unless the order of execution is clearly indicated. It should also be understood that additional or alternative steps may be used.

Although terms "first", "second", "third" and the like may be used herein to describe multiple elements, components, regions, layers and/or sections, these elements, components, regions, layers and/or sections should not be limited by these terms. These terms may only be used to distinguish one element, component, region, layer or section from another region, layer or section. Unless clearly indicated in the context, terms such as "first", "second" and other numerical terms do not imply an order or sequence when they are used herein. Therefore, the first element, component, region, layer or section discussed below may be referred to as a second element, component, region, layer or section without departing from the teachings of the exemplary embodiments.

For ease of description, spatial relative terms may be used herein to describe the relationship of one element or feature relative to another element or feature as shown in the drawings. These relative terms are, for example, "inner", "outer", "inside", "outside", "below", "under", "above", "over", etc. These spatial relative terms are intended to include different orientations of the device in use or in operation in addition to the orientation depicted in the drawings. For example, if the device in the figure is turned over, then elements described as "below other elements or features" or "under other elements or features" will be oriented as "above the other elements or features" or "over the other elements or features". Thus, the exemplary term "below" may include orientations of both above and below. The device can be otherwise oriented (rotated by 90 degrees or in other directions), and the spatial relationship descriptors used herein will be explained accordingly.

As shown in FIG. 1, a cooking device 1 according to the embodiment of the present application is specifically an OTR device combining a microwave oven with a range hood, in which the cooking device 1 includes a cabinet 10 and an installation bracket 20. The cabinet 10 includes an inner cavity 11 and a casing 12 sleeved over the inner cavity 11. The casing 12 is arranged spaced apart from the inner cavity 11 to prevent a user from being scalded by the high temperature of the inner cavity 11. A cooking chamber 111 is formed inside the inner cavity 11, and a high temperature can be generated in the cooking chamber 111 to heat the food. The cabinet 10 further includes a door 13. The door 13 is arranged at an opening of the inner cavity 11 and is rotatably connected to the casing 12, and the cooking chamber 111 can be opened or closed through the rotation of the door 13.

In one embodiment, the installation bracket 20 is typically fixed on a wall 2 in the room and is arranged at a height from the ground. The installation bracket 20 is configured to fix the cabinet 10 of the cooking device 1. The cabinet 10 is fixed on the installation bracket 20, and a lower part of the cabinet 10 is kept at a distance from the ground, and a stove 50 can be placed below the cabinet 10, and the cooking fume generated by the stove 50 during operation can be extracted and discharged by a fan assembly 30 in the cooking device 1. In this embodiment, the cabinet 10 and the installation bracket 20 are detachably connected, and the installation bracket 20 is provided with the fan assembly 30 and a fume exhaust duct 40 communicating with the fan assembly 30.

In an embodiment of the present application, the cabinet 10 and the fan assembly 30 are arranged separately. The fan assembly 30 is arranged on the installation bracket 20, and the fume exhaust duct 40 communicating with the fan assembly 30 is arranged inside the installation bracket 20. As compared with the integral structure of the fan assembly 30 and the cabinet 10 in the prior art, in the cooking device 1 in this embodiment, the weight of the fan assembly 30 is loaded on the installation bracket 20 in advance, and the original total weight of the fan assembly 30 and the cabinet 10 are split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction.

At the same time, by arranging the fume exhaust duct 40 in the installation bracket 20 and the oil fume is isolated from the various components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

Figure 2:
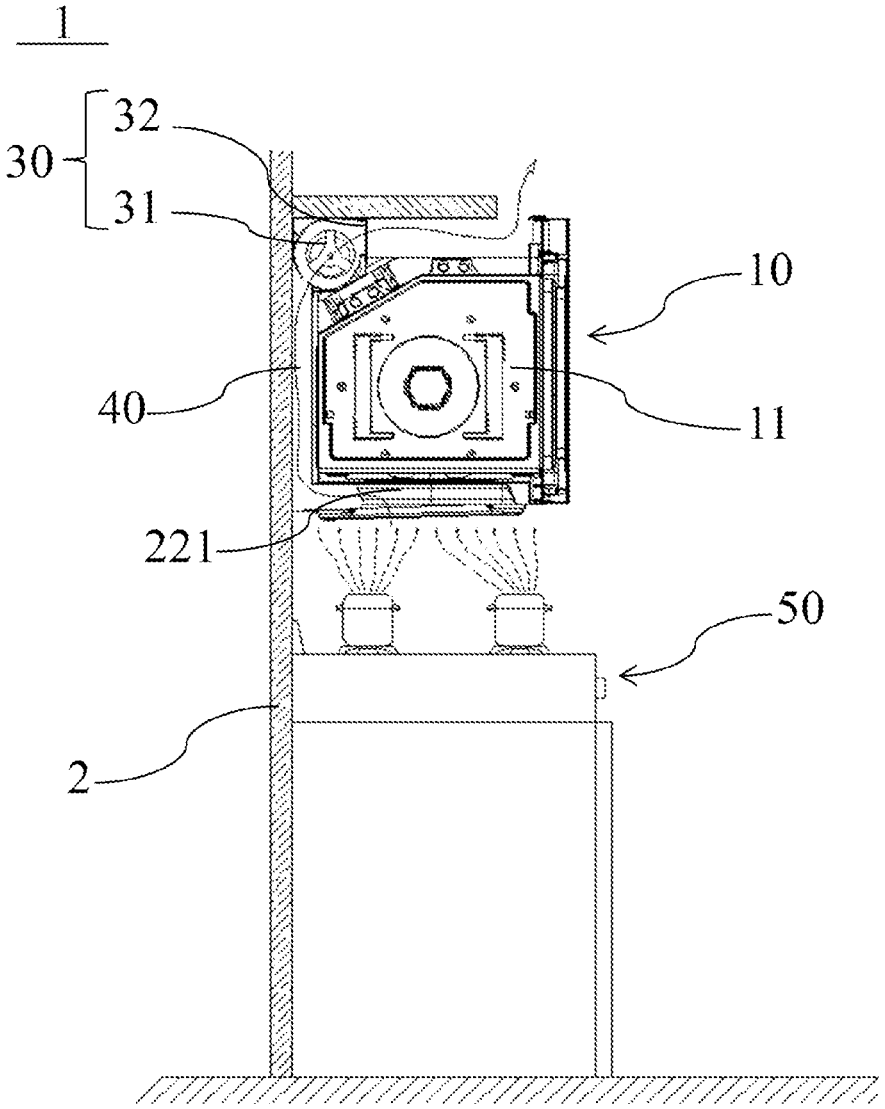
FIG. 2 is a schematic structural view of the cooking device in FIG. 1 after assembly.
Figure 3:
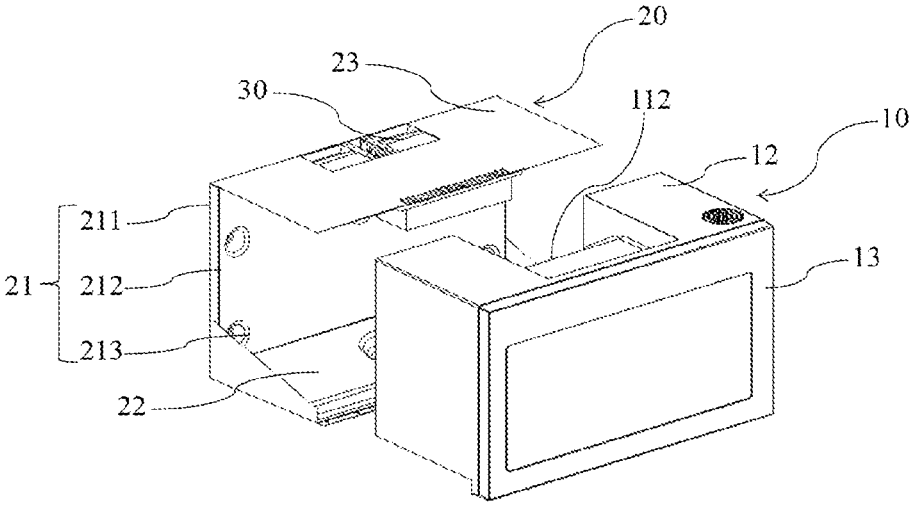
FIG. 3 is a schematic structural view showing a relative position when a cabinet and the installation bracket in FIG. 1 are assembled.

With reference to FIGS. 1 to 3, in an example of this embodiment, the installation bracket 20 includes an installation back plate 21, an installation bottom plate 22 and an installation top plate 23. The installation back plate 21 is arranged opposite to the cabinet 10, and the fume exhaust duct 40 is arranged in the interior of the installation back plate 21. The installation bottom plate 22 and the installation top plate 23 are respectively connected with a bottom and a top of the installation back plate 21, and the cabinet 10 is inserted into an opening structure enclosed by the installation bottom plate 22, the installation back plate 21 and the installation top plate 23. A C-shaped opening structure arranged toward the cabinet 10 is enclosed by the installation bottom plate 22, the installation back plate 21 and the installation top plate 23, and a size of the inner cavity of the C-shaped opening structure is larger than an outer size of the cabinet 10, and the cabinet 10 can be inserted into the C-shaped opening structure. In addition to forming an installation space for accommodating the cabinet 10, the installation bottom plate 22 also can provide a supporting and fixing effect to the bottom of the cabinet 10, to further support the cabinet 10 stably. The direction of the hollow arrow in FIG. 1 is a direction in which the cabinet 10 is inserted into the installation bracket 20.

In combination with FIG. 3 again, in an example of this embodiment, the installation back plate 21 includes a first installation back plate 211 and a second installation back plate 212 arranged opposite to each other, and the fume exhaust duct 40 is formed between the first installation back plate 211 and the second installation back plate 212, as shown in FIG. 2. The first installation back plate 211 and the second installation back plate 212 are sheet metal parts. Two sides of the first installation back plate 211 are provided with side edges extending toward the second installation back plate 212. By welding two sides of the second installation back plate 212 with the two side edges, the connection between the first installation back plate 211 and the second installation back plate 212 is realized, and a cavity is defined between the first installation back plate 211 and the second installation back plate 212 for forming the fume exhaust duct 40. By arranging the fume exhaust duct 40 in the cavity between the first installation back plate 211 and the second installation back plate 212 and it is arranged separately from the components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

Further, the second installation back plate 212 of this embodiment is provided with bulges 213 arranged toward the first installation back plate 211, and end faces of the bulges 213 are fitted and connected to the first installation back plate 211 for stably supporting the first installation back plate 211, and a stable double-layer structure with a spacing is formed between the first installation back plate 211 and the second installation back plate 212, to define the fume exhaust duct 40. In addition, there is very little obstruction in the fume exhaust duct 40, so the fume can flow therethrough freely, and the wind resistance is small, which effectively improves the fume exhaust effect of the cooking device 1; moreover, the fume exhaust duct 40 of a double-layer structure provides the installation bracket 20 with a strong support strength. In one embodiment, the bulges 213 may be formed on the surface of the second installation back plate 212 by means of stamping.

In other examples of this embodiment, side edges may also be provided on both sides of the second installation back plate 212, and the two side edges are welded with the first installation back plate 211, or bulges 213 arranged toward the second installation back plate 212 are provided on the first installation back plate 211, both of which situations can effectively form the fume exhaust duct 40 of a double-layer structure.

Figure 4:
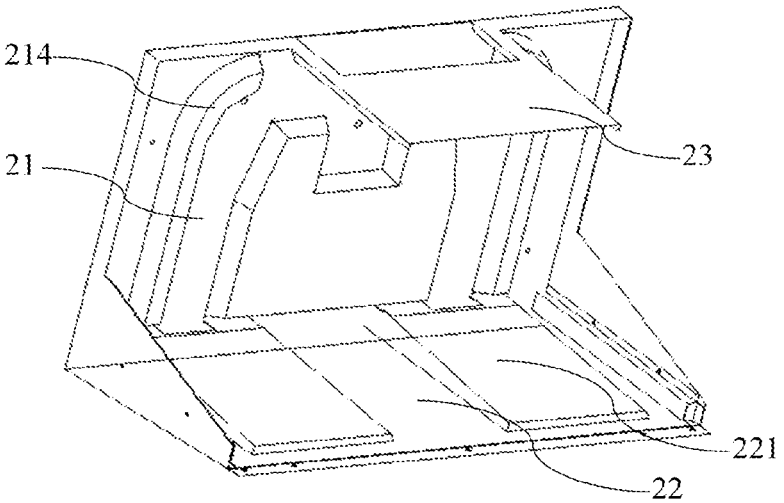
FIG. 4 is a schematic structural view of the installation bracket according to another example of the present disclosure.

With reference to FIGS. 2 and 4, in other examples of this embodiment, a duct structure may also be formed by stamping the installation back plate 21 to support the cabinet 10. The installation back plate 21 can be only one layer of sheet metal part, and ribs 214 arranged toward the cabinet 10 are formed by stamping. The ribs 214 are in close contact with a back surface of the cabinet 10, and a fume exhaust duct is formed between the cabinet 10 and the installation back plate 21. The arrangement direction of the ribs 214 defines the flow direction of gas flow in the fume exhaust duct 40. The structure in this example can also isolate the fume exhaust duct 40 from the various components in the cabinet 10, and a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

In other examples of this embodiment, in addition to the double-layer sheet metal structure and the structure formed by stamping for the fume exhaust duct 40, a pipeline made of sheet metal or plastic may also directly communicate with the fan assembly 30, to discharge the oil fume generated by the stove 50. The shape of the cross section of the pipeline may be various shapes such as square, circle or ellipse, and the specific shape is not limited.

In other examples of this embodiment, the fume exhaust duct 40 may also be arranged inside the cabinet 10, and the fan assembly 30 communicates with the fume exhaust duct 40 inside the cabinet 10. The oil fume generated by the stove 50 can be extracted into the fume exhaust duct 40 in the cabinet 10 under the action of the fan assembly 30, and by providing a pipeline above the cabinet for communicating with the fume exhaust duct 40, the oil fume is finally discharged outdoors.

Referring to FIGS. 1 to 3 again, in an example of this embodiment, the fan assembly 30 of the cooking device 1 is provided above the installation back plate 21, and the fume exhaust duct 40 is an intake passage. The fan assembly 30 includes a fan body 31 and a fan housing 32, the fan body 31 is arranged inside the fan housing 32, and the fan housing 32 is provided with an installation sloping plate 322 arranged toward the cabinet 10. The cabinet 10 is provided with an inclined plate 112 arranged opposite to the installation sloping plate 322. The fan housing 32 is connected with the installation top plate 23 to fix the fan assembly 30 on the installation bracket 20. The fan body 31 communicates with the fume exhaust duct 40. The oil fume generated by the stove 50 is extracted through the fume exhaust duct 40, and is finally discharged outdoors through the pipeline. At this time, the fume exhaust duct 40 is connected to an intake port of the fan assembly, and is configured to convey the oil fume to the fan assembly 30. Therefore, the fume exhaust duct 40 is the intake passage of the fan assembly 30.

It should be understood that when a user is facing the cooking device 1, a distance from the side of the cooking device 1 close to the user to the side of the cooking device 1 away from the user is a width of the cooking device 1, a distance from the user's left-hand side to the user's right-hand side is a length of the cooking device 1, and a distance from the side of the cooking device 1 close to the bottom surface to the side of the cooking device 1 away from the bottom surface is a height of the cooking device 1.

In the prior art, the fan assembly is located at the top of the inner cavity 11, and the top of the inner cavity 11 forms a rectangular space in the width direction of the cooking device 1 and the length direction of the cooking device 1. A volume of the rectangular space is much larger than that of the fan assembly. Due to the existence of the rectangular space, the size of the cooking chamber 111 in the height direction of the cooking device 1 is affected. In some examples of this embodiment, the inclined plate 112 is arranged at the corner position of the cooking chamber 111, the fan housing 32 is arranged corresponding to the inclined plate 112, and the installation sloping plate 322 arranged opposite to the inclined plate 112 is provided on the fan housing 32, and the fan housing 32 only occupies a small space in the height direction and other directions (width or length direction) of the cooking device 1 after installation. Therefore, the overall space utilization of the cooking device 1 can be improved, and the volume of the cooking chamber 111 is effectively increased, to improve the processing capability of the cooking device 1 to the food.

When the cooking device 1 needs to be installed, the fan housing 32 of the fan assembly 30 is installed on the installation top plate 23 first, and the specific connection means may be various methods such as insertion, riveting or bolt connection. After the fan assembly 30 is installed and fixed, the cabinet 10 is inserted into the C-shaped opening structure enclosed by the installation back plate 21, the installation bottom plate 22 and the installation top plate 23, and by arranging the inclined plate 112 and the installation sloping plate 322 opposite to each other, the installation strength of the cooking device 1 during installation can be effectively reduced, and the overall space utilization of the cooking device 1 is improved, and the volume of the cooking chamber 111 is effectively increased, to improve the processing capability of the cooking device 1 to the food.

As shown in FIG. 1 again, in an example of this embodiment, the inner cavity 11 further includes a rear side plate 113 and a top plate 114, and the top plate 114 is connected to the rear side plate 113 through the inclined plate 112. In one embodiment, the rear side plate 113 and the top plate 114 are respectively configured to form the cooking chamber 111, and the rear side plate 113 is connected to the top plate 114 through the inclined plate 112, that is, the inclined plate 112 is arranged at a corner position above the rear of the cooking chamber 111. When installing the fan assembly 30, the fan housing 32 is arranged outside the cooking chamber 111 and arranged corresponding to the inclined plate 112, that is, the fan housing 32 is installed at the corner position outside the cooking chamber 111, which further reduces the volume occupied by the fan assembly 30 during installation, and the volume of the cooking chamber 111 can be effectively increased.

It should be understood that in the present application, the rear side plate 113 and the top plate 114 are spaced apart and perpendicular to each other, and the two are connected and fixed by the inclined plate 112.

In addition, the rear side plate 113, the inclined plate 112 and the top plate 114 may be of a split structure or an integral structure. In a case where the rear side plate 113, the inclined plate 112 and the top plate 114 are of a split structure, they are processed by stamping (all the three are metal sheets), to improve the convenience of processing. In a case where the rear side plate 113, the inclined plate 112 and the top plate 114 are a split structure, they are processed and manufactured respectively, and then connected and fixed by welding or riveting. The split processing and manufacturing have a low cost, which effectively reduces the manufacturing cost of the cooking device 1.

In an example of this embodiment, the inclined plate 112 is of a flat plate structure, and a width of the flat plate structure (a distance of the inclined plate 112 between the top plate 114 and the rear side plate 113) is larger than a width of the fan assembly 30. When the fan body assembly 30 is arranged corresponding to the inclined plate 112, installation of the fan assembly 30 only affects part of the space at the top of the rear side of the cooking chamber 111, and the volume of the cooking chamber 111 is effectively increased compared with the previous case.

Figure 5:
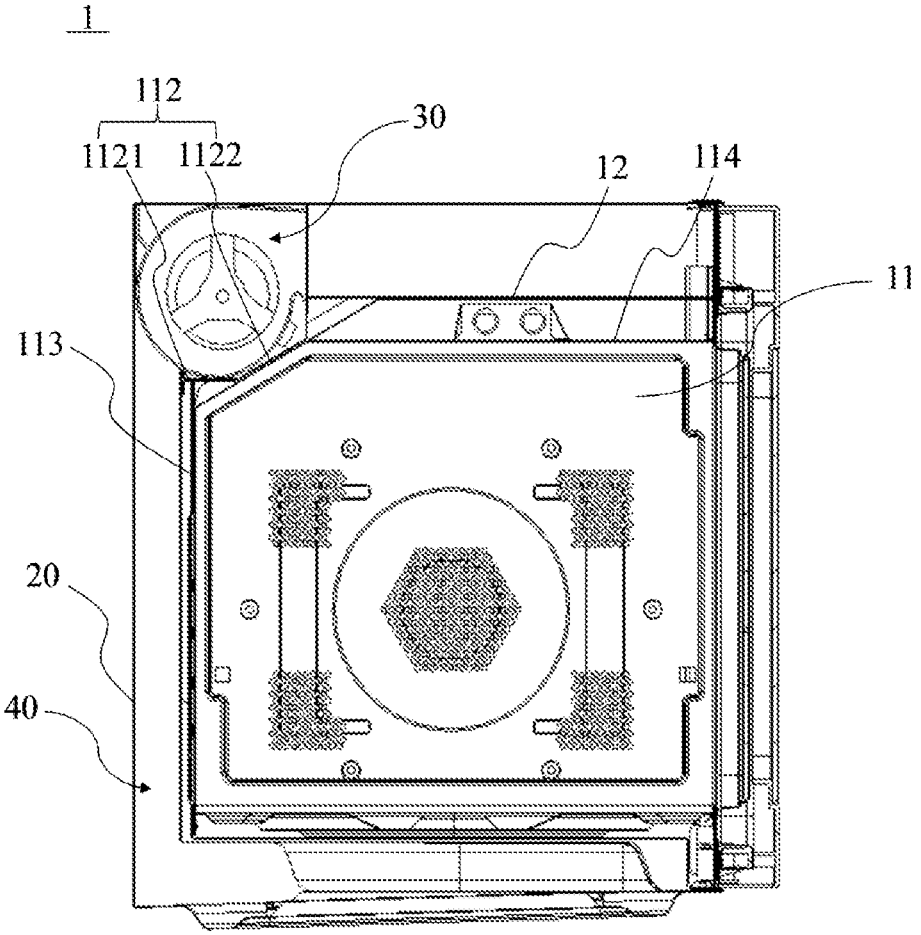
FIG. 5 is a schematic structural view after the cabinet and the installation bracket are assembled according to another example of the present disclosure.

In other examples of this embodiment, as shown in FIG. 5, the inclined plate 112 includes a first plate body 1121 and a second plate body 1122 connected with each other at an obtuse angle. The first plate body 1121 is perpendicularly connected to the rear side plate 113 and is parallel to the top plate 114. The second plate body 1122 is connected to the top plate 114. In one embodiment, the first plate body 1121 and the second plate body 1122 are connected to each other, in which the first plate body 1121 is perpendicularly connected to the rear side plate 113, and the second plate body 1122 is connected to the top plate 114. The fan assembly 30 corresponds to the position of the inclined plate 112. An included angle between the first plate body 1121 and the second plate body 1122 is set to an obtuse angle (at the connection position outside the cooking chamber 111), and the shape between the first plate body 1121 and the second plate body 1122 better fits the fan assembly 30, which can further reduce the space occupied by the fan assembly 30 during installation, and the overall space utilization of the cooking device 1 is effectively improved.

In other examples of this embodiment, the inclined plate 112 may also be an arc-shaped plate, and the shape of the arc-shaped plate is adapted to the shape of the fan assembly 30, and the waste of space can be further reduced and the space utilization of the cooking device 1 can be further improved. As such, the volume of the cooking chamber 111 can be effectively increased, and the processing capability to the food is effectively improved.

Figure 6:
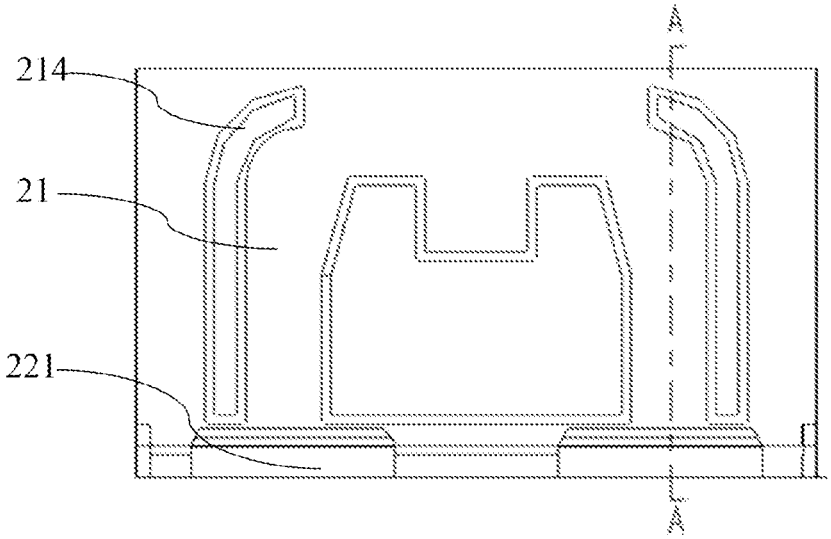
FIG. 6 is a schematic structural view of the installation bracket in FIG. 4 from another perspective.
Figure 7:
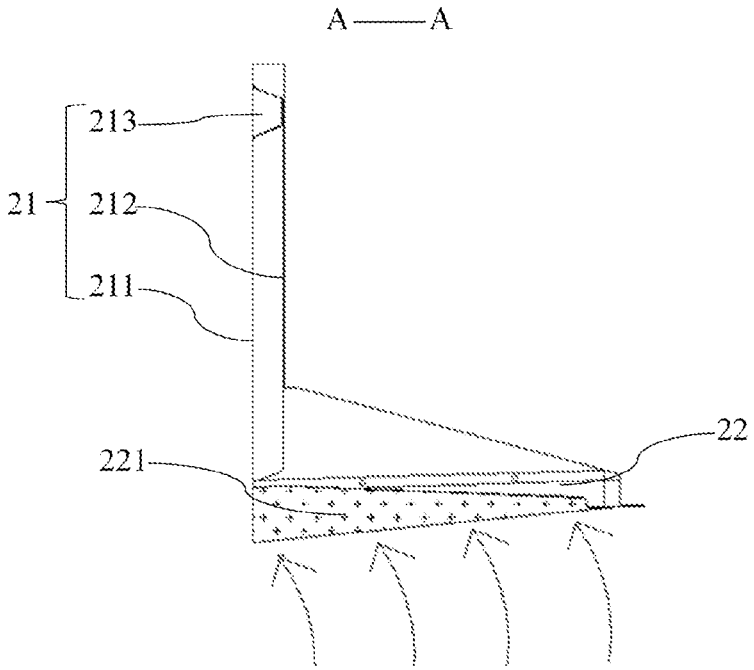
FIG. 7 is a schematic cross-sectional structural view of the installation bracket in FIG. 6 taken along line A-A.

With reference to FIGS. 2, 4, 6 and 7, in an example of this embodiment, the bottom of the installation bracket 20 is provided with second intake ports 221, and the second intake ports 221 communicate with the fume exhaust duct 40, and the installation bracket 20 forms a C-shaped duct structure as a whole. The oil fume generated when the stove 50 is working can enter the fume exhaust duct 40 through the second intake ports 221 on both sides of the bottom of the installation bracket 20, and finally can be discharged outdoors through the extraction effect of the fan assembly 30. The second intake ports 221 adopt a fume collecting cavity structure of the shape of a bell mouth, to effectively prevent the oil fume from overflowing the second intake ports 221 during the extraction process, strengthen the effect of collecting fume and discharging fume, and realize the purpose of rapid fume discharge. In one embodiment, the second intake ports 221 can be obtained by implementing a stamping technique on the installation bottom plate 22, and the fume collecting cavity structure after stamping also improves the mechanical strength of the installation bottom plate 22. The direction of the arc-shaped arrow in FIG. 6 represents the discharge direction of the oil fume generated by the stove 50.

Figure 8:
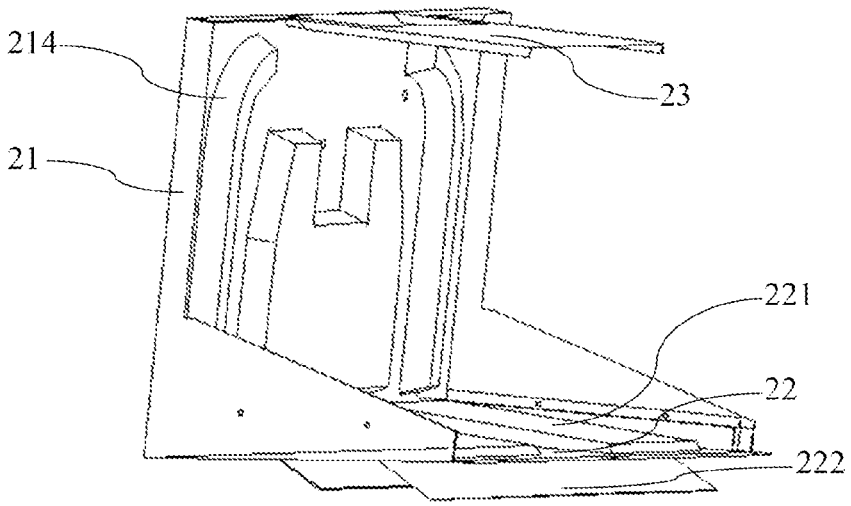
FIG. 8 is a schematic structural view of the installation bracket with a flow guide plate according to another example of the present disclosure.
Figure 9:
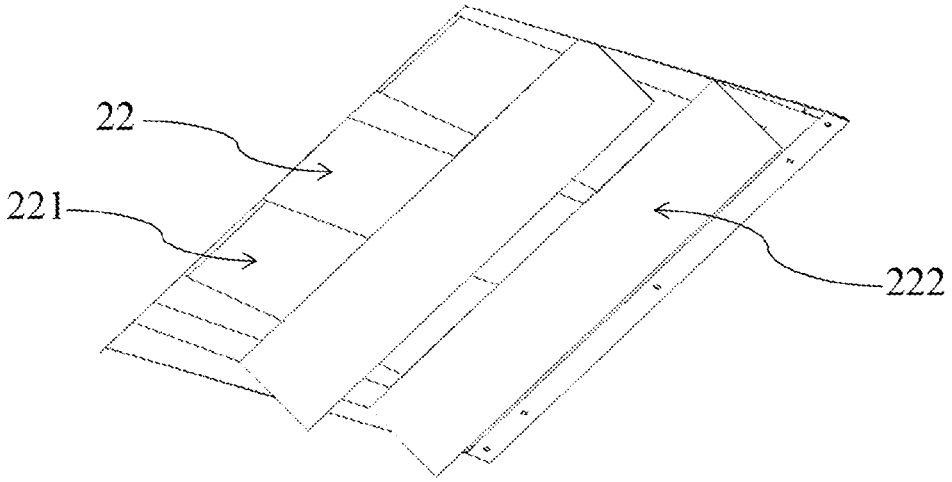
FIG. 9 is a schematic structural view of an installation bottom plate in FIG. 8.

As shown in FIG. 8 and FIG. 9, in an example of this embodiment, the bottom of the installation bracket 20 is further provided with a flow guide plate 222. By adding a movably connected flow guide plate 222 at the second intake ports 221 of the installation bottom plate 22, the effect of discharging the oil fume of the cooking device 1 can be further improved. The flow guide plate 222 is arranged along the length direction of the installation bottom plate 22, and both ends of the flow guide plate 222 in the length direction are connected to both sides of the installation bottom plate 22 in a rotatable manner, and a turning direction of the flow guide plate 222 can be adjusted. The oil fume generated when the stove 50 is working is unstable in the flow state and the flow direction in the horizontal direction is uncertain, so it is easy for the oil fume to escape to other places in the kitchen. In order to prevent the oil fume from escaping, it is necessary to open the fan assembly 30 and the second intake ports 221, to suck the oil fume generated by the stove 50 into the fume exhaust passage 40 and finally discharge it outdoors. When the stove 50 is not working, it is not necessary to open the flow guide plate 222 to guide the oil fume generated by the stove 50, and the flow guide plate 222 is accommodated at the bottom of the installation bottom plate 22, to reduce the space occupation and maintaining a beautiful appearance. When the stove 50 works and generates the oil fume, a turning angle of the flow guide plate 222 is adjusted according to the magnitude of the flow rate of the oil fume, to change a shielding area of the flow guide plate 222 on the second intake ports 221 and the flow direction of the oil fume, to guide the oil fume to come into the second intake ports 221 and finally be discharged through the fume exhaust duct 40, which improves the discharge process of the oil fume.

Figure 10:
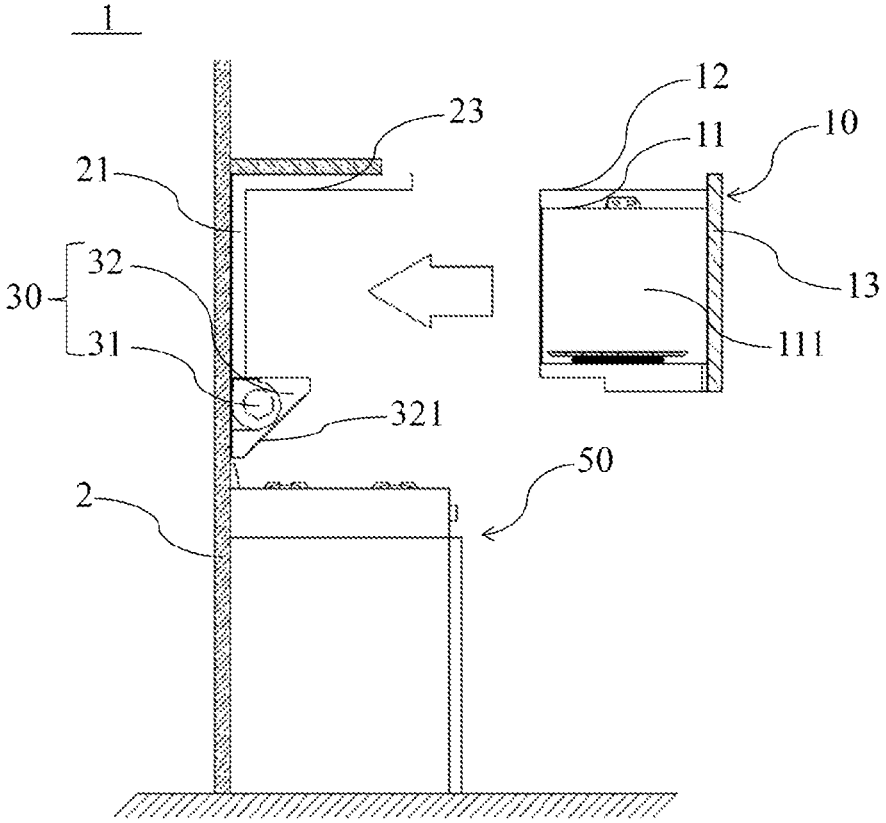
FIG. 10 is a schematic structural view of the cooking device with the installation bracket having a F-shaped structure according to the present disclosure before assembly.
Figure 11:
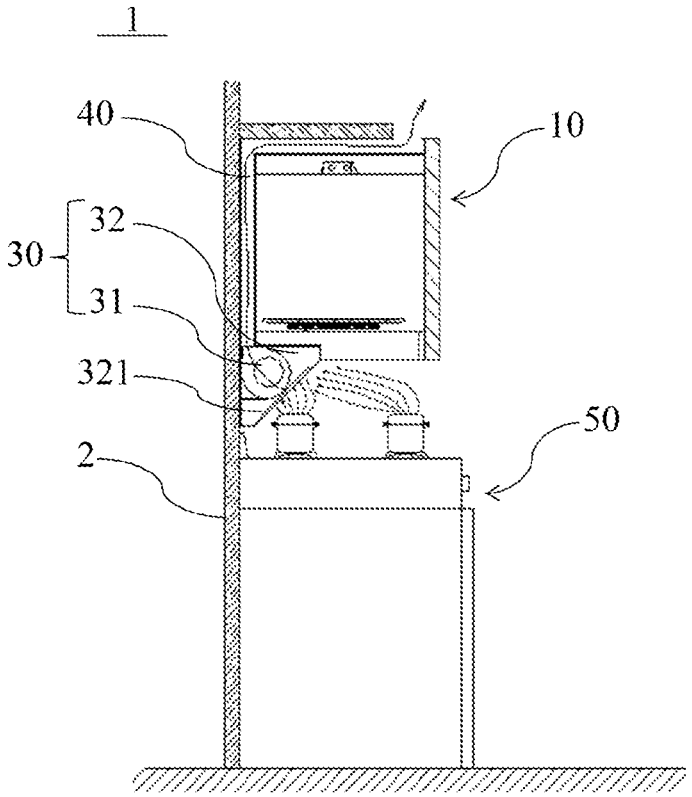
FIG. 11 is a schematic structural view of the cooking device in FIG. 10 after assembly.

In other examples of this embodiment, as shown in FIG. 10 and FIG. 11, the fan assembly 30 is arranged below the installation back plate 21, and the fume exhaust duct 40 is connected to an exhaust port of the fan assembly 30 to serve as an exhaust passage, and the installation bracket 20 forms an F-shaped duct structure as a whole. By placing the fan assembly 30 below the installation back plate 21, the weight of the fan assembly 30 is loaded on the installation bracket 20 in advance, and the original total weight of the fan assembly 30 and the cabinet 10 is split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction. Since the fan housing 32 is provided with a first intake port (not shown in the figure) for extracting the oil fume in this example, the structure of the installation bottom plate 22 and the second intake ports 221 can be correspondingly reduced. The direction of the hollow arrow in FIG. 10 indicates the insertion direction of the cabinet 10.

At the same time, by placing the fan assembly 30 below the installation bracket 20, the space occupation of the fan assembly 30 in the installation bracket 20 can be further reduced, to correspondingly enlarge the volume of the cooking chamber 111 in the cabinet 10, increasing the food storage space of the cooking chamber 111, and further improving the cooking efficiency of the cooking device 1. In addition, the space between the installation bracket 20 and the stove 50 can also be effectively utilized, to improve the space utilization.

In one embodiment, the fan housing 32 is connected to the bottom surface of the installation bottom plate 22, the bottom of the fan housing 32 is provided with a first inclined surface 321 arranged toward the stove 50, and the first inclined surface 321 is provided with a first intake port. In this example, the fan assembly 30 is arranged closer to the stove 50, and the oil fume generated by the stove 50 can, before being diffused, directly enter the fume exhaust passage 40 through the first intake port under the extraction action of the fan assembly 30, and is finally discharged outdoors.

Figure 12:
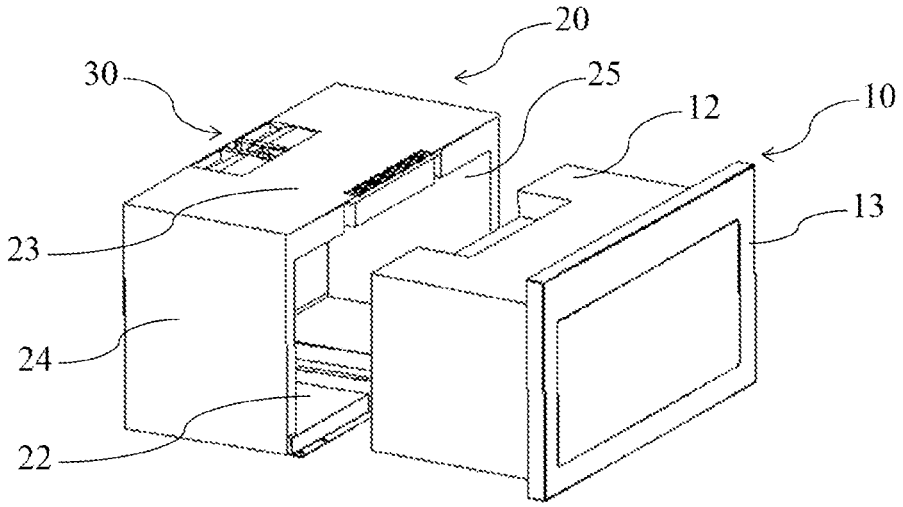
FIG. 12 is a schematic structural view showing a relative position when the installation bracket with a structure of one square encircled by another bigger one is assembled with the cabinet according to the present disclosure.
Figure 13:
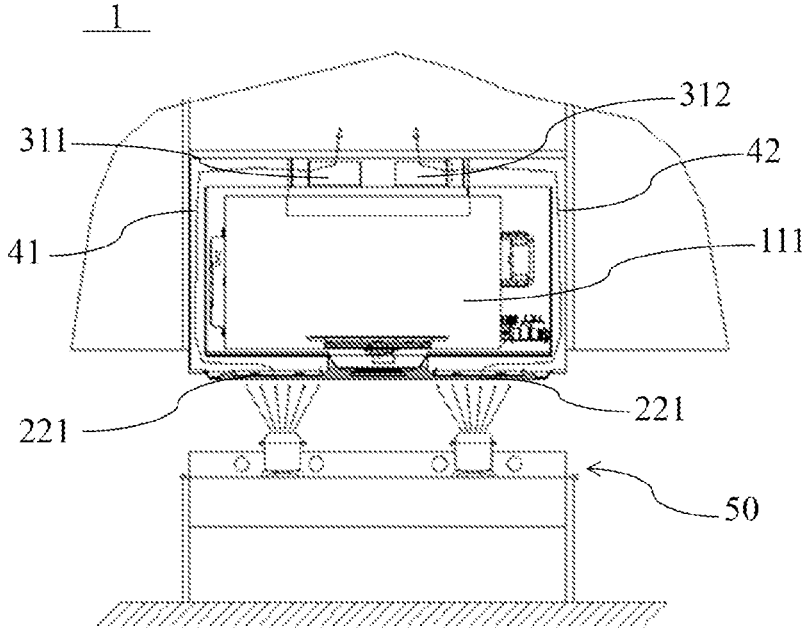
FIG. 13 is a schematic front structural view of the cooking device with the installation bracket in FIG. 12.

In other examples of this embodiment, as shown in FIG. 12, the installation bracket 20 includes an installation top plate 23, a first installation side plate 24, an installation bottom plate 22 and a second installation side plate 25 that are connected end to end in sequence. The installation top plate 23, the first installation side plate 24, the installation bottom plate 22 and the second installation side plate 25 enclose to form a structure of one square encircled by another bigger one, and the cabinet 10 is inserted into the structure of one square encircled by another bigger one enclosed by the installation top plate 23, the first installation side plate 24, the installation bottom plate 22 and the second installation side plate 25. The fan housing 32 is connected with the installation top plate 23, and the fan housing 32 is also provided with an installation sloping plate 322 arranged toward the cabinet 10. The cabinet 10 is provided with an inclined plate 112 arranged opposite to the installation sloping plate 322, to increase the volume in the cooking chamber 111, which effectively improves the cooking efficiency. The first installation side plate 24 and/or the second installation side plate 25 is provided therein with a fume exhaust duct 40, to form a fume exhaust duct 40 of a shape of one square encircled by another bigger one (i.e., a space enclosed by a rectangle and another rectangle inside the rectangle). The fan body 31 is arranged in the fan housing 32 and communicates with the fume exhaust duct 40, and the oil fume generated by the stove 50 is discharged through the side plates of the installation bracket 20. The direction of the arrows in FIGS. 12 and 13 is the flow direction of the oil fume in the fume exhaust duct. The cooking device 1 in this example can also reduce the labor intensity during the installation of the cabinet 10, facilitate the installation and disassembly of the cooking device 1, and at the same time can effectively reduce the space occupation of the fan assembly 30 in the installation bracket 20, to correspondingly enlarge the volume of the cooking chamber 111 in the cabinet 10, increasing the food storage space in the cooking chamber 111, and further improving the cooking efficiency of the cooking device 1.

At the same time, the fume exhaust duct 40 is arranged in the installation bracket 20 and is isolated from the components in the cabinet 10, which can effectively reduce the flow resistance during the fume discharge process, improve the fume exhaust speed, and ensure the fume exhaust effect. Moreover, there will be no damage caused to various components in the cabinet 10 in the long-term fume exhaust process, a reliable operation of each component is ensured, and the service life of the cooking device 1 is improved.

Figure 14:
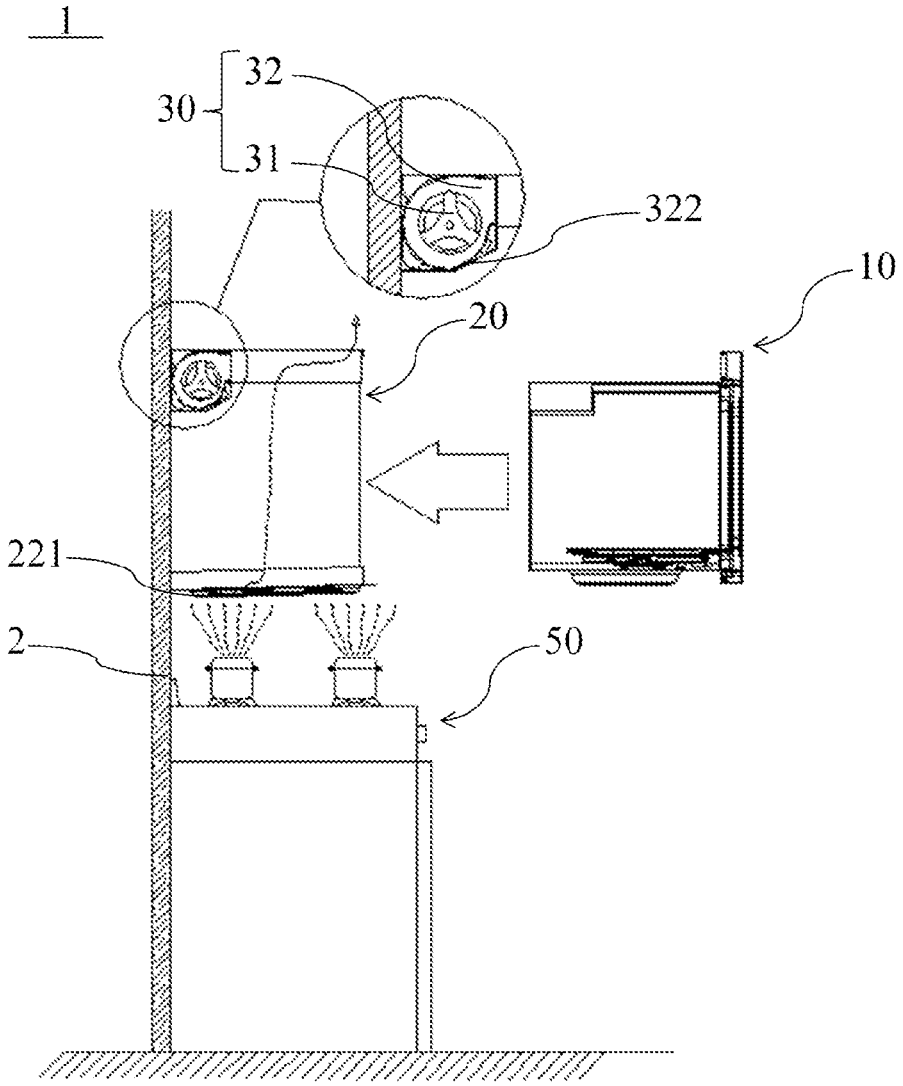
FIG. 14 is a schematic side structural view of the cooking device with the installation bracket in FIG. 12.

As shown in FIGS. 12 to 14, the fan body 31 includes a first fan 311 and a second fan 312, and the fume exhaust duct 40 includes a first fume exhaust duct 41 arranged in the first installation side plate 24 and a second fume exhaust duct 42 arranged in the second installation side plate 25. The first fan 311 communicates with the first fume exhaust duct 41, and the second fan 312 communicates with the second fume exhaust duct 42, and the first fan 311 and the second fan 312 act on the first fume exhaust duct 41 and the second fume exhaust duct 42 respectively, which ensures the conveying efficiency of the oil fume and increases the oil fume exhaust speed of the cooking device 1.

In other examples of this embodiment, the fan assembly 30 may also be arranged below the structure of one square encircled by another bigger one enclosed by the installation top plate 23, the first installation side plate 24, the installation bottom plate 22 and the second installation side plate 25, that is, the fan housing 32 is connected to the bottom surface of the installation bottom plate 22, and the fan body 31 is arranged inside the fan housing 32 and communicates with the fume exhaust ducts 40 on both sides.

In other examples of this embodiment, third intake ports (not shown in the figure) may also be provided at edges positions on both sides of the bottom of the installation bracket 20, and the third intake ports communicate with the fume exhaust duct 40 in the installation bracket 20, and when the fan assembly 30 is working, a gas flow system similar to a wind curtain is formed below the installation bracket 20 through the third intake ports on both sides of the installation bottom plate 22, to effectively prevent the oil fume generated by the stove 50 from spreading all around and ensuring the fume exhaust effect of the cooking device 1.

In one embodiment, when the installation bracket 20 is of a structure of one square encircled by another bigger one or a C-shaped structure, the third intake ports may be arranged at the edge positions on both sides of the installation bottom plate 22; and when the installation bracket 20 is of an F-shaped structure, the third intake ports may be arranged at the edge positions on both sides of the first inclined surface 321 of the fan housing 32. In the above arrangement, corresponding fan structures may each be further added at the third intake ports to ensure the intensity of gas flow.

Further, in other examples of this embodiment, each installation surface inside the installation bracket 20 is substantially planar, and there is a smooth transition between the installation surfaces, and when the cabinet 10 is not installed inside the installation bracket 20, the installation bracket can be used as a storage device, to improve the utilization efficiency of the installation bracket 20.

The cooking device 1 of this embodiment further includes a first power supply line (not shown in the figure) and a second power supply line (not shown in the figure), in which the first power supply line is configured to supply power to the cabinet 10, and the cooking chamber is 111 works and cooks the food, and the second power supply line is configured to supply power to the fan assembly 30, and the oil fume generated by the stove 50 is discharged through the fan assembly 30.

In an embodiment of the present application, as shown in FIG. 10 and FIG. 11, the cooking device 1 includes the cabinet 10, the fan assembly 30 and the installation bracket 20. The cabinet 10 is connected with the installation bracket 20, and the cabinet 10 includes the inner cavity 11 and the casing 12 sleeved outside the inner cavity 11. The casing 12 is arranged spaced apart from the inner cavity 11, to prevent the user from being scalded by the high temperature of the inner cavity 11. The cooking chamber 111 is formed inside the inner cavity 11, and a high temperature can be generated in the cooking chamber 111, and the food can be heated. The cabinet 10 further includes a door 13. The door 13 is arranged at the opening of the inner cavity 11 and is rotatably connected with the casing 12, and the cooking chamber 111 can be opened or closed through the rotation of the door 13. The direction of the hollow arrow in FIG. 10 indicates the insertion direction of the cabinet 10.

In one embodiment, the installation bracket 20 is typically fixed on the wall 2 in the room and is arranged at a height from the ground. The installation bracket 20 is configured to fix the cabinet 10 of the cooking device 1. The cabinet 10 is fixed on the installation bracket 20, and a lower part of the cabinet 10 is kept at a distance from the ground, and the stove 50 can be arranged below the cabinet 10, and the oil fume generated by the stove 50 during work can be extracted and discharged by the fan assembly 30 in the cooking device 1.

In an example of this embodiment, the cabinet 10 and the fan assembly 30 are arranged separately, and the installation bracket 20 includes the installation back plate 21 and the installation top plate 23, in which the installation back plate 21 is arranged opposite to the cabinet 10, the installation back plate 21 is provided with the fume exhaust duct 40 communicating with the fan assembly 30, and the fan assembly 30 is connected to the bottom of the installation back plate 21 and communicates with the fume exhaust duct 40. The fan assembly 30 can directly act on the oil fume generated by the stove 50 below the installation bracket 20, extract the oil fume into the fume exhaust duct 40 before spreading and discharge it outdoors.

In the cooking device 1 in this example, by placing the fan assembly 30 below the installation back plate 21, the space between the installation bracket 20 and the stove 50 can be effectively utilized, and the space utilization can be improved. In addition, the space occupation of the fan assembly 30 in the installation bracket 20 can also be reduced, to correspondingly enlarge the volume of the cooking chamber 111 in the cabinet 10, increasing the food storage space in the cooking chamber 111, and further improving the cooking efficiency of the cooking device 1.

At the same time, in this example, the fume exhaust duct 40 is arranged in the installation bracket 20, and the oil fume is isolated from the various components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

In an example of this embodiment, the cabinet 10 and the fan assembly 30 are arranged separately, the fan assembly 30 is arranged below the installation back plate 21, the weight of the fan assembly 30 is loaded on the installation bracket 20 in advance, and the original total weight of the fan assembly 30 and the cabinet 10 is split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction.

The fan assembly 30 includes the fan body 31 and the fan housing 32, the fan body 31 is arranged in the fan housing 32, the fan housing 32 is connected to the bottom of the installation back plate 21, and the bottom of the fan housing 32 is provided with the first inclined surface 321 which is provided with the first intake port (not shown in the figure) communicating with the fume exhaust duct 40. The oil fume generated by the stove 50 can directly enter the fume exhaust passage 40 through the first intake port under the extraction action of the fan assembly 30, and is finally discharged outdoors. During this process, the fume exhaust duct 40 is connected to the exhaust port of the fan assembly 30, and is the exhaust passage. Since the fan housing 32 in this embodiment is provided with the first intake port (not shown in the figure) for sucking the oil fume, the structure of the installation bottom plate 22 and the second intake ports 221 can be correspondingly reduced.

As shown in FIG. 3 and FIG. 11, in an example of this embodiment, the installation back plate 21 also includes the first installation back plate 211 and the second installation back plate 212 arranged opposite to each other, and the fume exhaust duct 40 is formed between the first installation back plate 211 and the second installation back plate 212. The first installation back plate 211 and the second installation back plate 212 are sheet metal parts. Two sides of the first installation back plate 211 are provided with side edges extending toward the second installation back plate 212. By welding two sides of the second installation back plate 212 with the two side edges, the connection between the first installation back plate 211 and the second installation back plate 212 is realized, and a cavity is defined between the first installation back plate 211 and the second installation back plate 212 for forming the fume exhaust duct 40. By arranging the fume exhaust duct 40 in the cavity between the first installation back plate 211 and the second installation back plate 212 and it is arranged separately from the components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

Further, the second installation back plate 212 is provided with bulges 213 arranged toward the first installation back plate 211, and end faces of the bulges 213 are fitted and connected to the first installation back plate 211 for stably supporting the first installation back plate 211, and a stable double-layer structure where spacing is formed between the first installation back plate 211 and the second installation back plate 212, to define the fume exhaust duct 40. In addition, there is very little obstruction in the fume exhaust duct 40, so the fume can flow therethrough freely, and the wind resistance is small, which effectively improves the fume exhaust effect of the cooking device 1; moreover, the fume exhaust duct 40 of a double-layer structure provides the installation bracket 20 with a strong support strength. In one embodiment, the bulges 213 may be formed on the surface of the second installation back plate 212 by means of stamping.

In other examples of this embodiment, side edges may also be provided on both sides of the second installation back plate 212, and the two side edges are welded with the first installation back plate 211, or bulges 213 arranged toward the second installation back plate 212 are provided on the first installation back plate 211, both of which situations can effectively form the fume exhaust duct 40 of a double-layer structure.

With reference to FIGS. 4 and 11, in other examples of this embodiment, an independent duct structure may also be formed by stamping the installation back plate 21 to support the cabinet 10. The installation back plate 21 can be only one layer of sheet metal part, and ribs 214 arranged toward the cabinet 10 are formed by stamping. The ribs 214 are in close contact with a back surface of the cabinet 10, and the fume exhaust duct 40 is formed between the cabinet 10 and the installation back plate 21. The arrangement direction of the ribs 214 defines the flow direction of gas flow in the fume exhaust duct 40. The structure in this example can also isolate the fume exhaust duct 40 from the various components in the cabinet 10, and a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

In other examples of this embodiment, in addition to the double-layer sheet metal structure and the structure formed by stamping for the fume exhaust duct 40, a pipeline made of sheet metal or plastic may also directly communicate with the fan assembly 30, to discharge the oil fume. The shape of the cross section of the pipeline may be various shapes such as square, circle or ellipse, and the specific shape is not limited.

When the cooking device 1 needs to be installed, the fan assembly 30 is first installed at the bottom of the installation back plate 21, and the specific connection means may be various methods such as insertion, riveting or bolt connection. After the fan assembly 30 is installed and fixed, the cabinet 10 is installed on the installation back plate 21, and the installation strength of the cooking device 1 during installation can be effectively reduced. Meanwhile, by placing the fan assembly 30 below the installation back plate 21, the installation space is larger compared to a situation in which the fan assembly 30 is installed inside the installation bracket 20, which facilitates installation and disassembly of the fan assembly 30.

In other examples of this embodiment, the installation bracket 20 may further include the installation top plate 23, the first installation side plate 24, the installation bottom plate 22 and the second installation side plate 25 that are connected end to end in sequence. The installation top plate 23, the first installation side plate 24, the installation bottom plate 22 and the second installation side plate 25 enclose to form a structure of one square encircled by another bigger one, and the cabinet 10 is inserted into the structure of one square encircled by another bigger one (i.e., a space enclosed by a rectangle and another rectangle inside the rectangle) enclosed by the installation top plate 23, the first installation side plate 24, the installation bottom plate 22 and the second installation side plate 25.

The fan housing 32 is connected with the bottom surface of the installation bottom plate 22, and the fan assembly 30 is placed below the installation bracket. The first installation side plate 24 and/or the second installation side plate 25 is provided therein with the fume exhaust duct 40, to form the fume exhaust duct 40 of the shape of one square encircled by another bigger one. The fan body 31 is arranged in the fan housing 32 and communicates with the fume exhaust duct 40, and the oil fume generated by the stove 50 is discharged through the side plates of the installation bracket 20. The direction of the arrows in FIGS. 12 and 13 is the flow direction of the oil fume in the fume exhaust duct 40. The fume exhaust duct 40 communicates with the exhaust port of the fan assembly 30, so it is the exhaust passage.

The fan body 31 in this example may also include the first fan 311 and the second fan 312, both of which are arranged below the installation bottom plate through the fan housing 32, and the fume exhaust duct 40 includes the first fume exhaust duct 41 arranged in the first installation side plate 24 and the second fume exhaust duct 42 arranged in the second installation side plate 25. The first fan 311 communicates with the first fume exhaust duct 41, and the second fan 312 communicates with the second fume exhaust duct 42, and the first fan 311 and the second fan 312 act on the first fume exhaust duct 41 and the second fume exhaust duct 42 respectively, which ensures the conveying efficiency of the oil fume and increases the oil fume exhaust speed of the cooking device 1.

Figure 15:
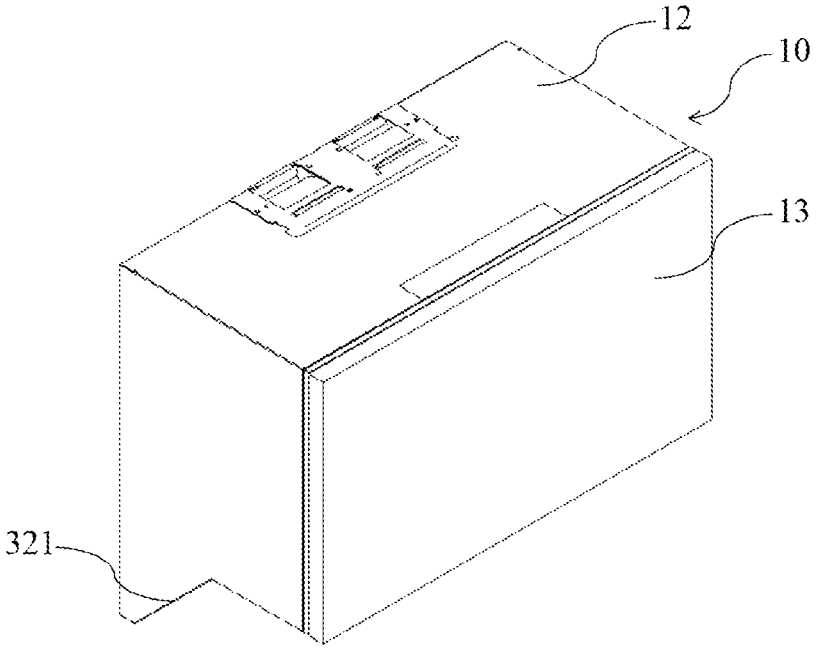
FIG. 15 is a schematic structural view of the cabinet according to another example of the present disclosure.

In other examples of this embodiment, as shown in FIG. 11 and FIG. 15, the fan assembly 30 is connected to the cabinet 10 and arranged below the installation back plate 21, and the fan assembly 30 and the cabinet 10 are of an integral structure. During installation, the cabinet 10 is connected to the installation back plate 21, and the fan assembly 30 is naturally located below the cabinet 10, which can also effectively utilize the installation space between the installation bracket 20 and the stove 50 and improve the space utilization. At the same time, the space occupation of the fan assembly 30 in the installation bracket 20 is reduced, to correspondingly enlarge the volume of the cooking chamber 111 in the cabinet 10, increasing the food storage space of the cooking chamber 111, and further improving the cooking efficiency of the cooking device 1.

In other examples of this embodiment, the fume exhaust duct 40 may also be arranged inside the cabinet 10, and the fan assembly 30 communicates with the fume exhaust duct 40 inside the cabinet 10. The oil fume generated by the stove 50 can be extracted into the fume exhaust duct 40 in the cabinet 10 under the action of the fan assembly 30, and by providing a pipeline above the cabinet 10 for communicating with the fume exhaust duct 40, the oil fume is finally discharged outdoors.

In other examples of this embodiment, third intake ports (not shown in the figure) may also be provided at edges positions on both sides of the bottom of the installation bracket 20, and the third intake ports communicate with the fume exhaust duct 40 in the installation bracket 20, and when the fan assembly 30 is working, a gas flow system similar to a wind curtain is formed below the installation bracket 20 through the third intake ports on both sides of the installation bottom plate 22, to effectively prevent the oil fume generated by the stove 50 from spreading all around and ensuring the fume exhaust effect of the cooking device 1.

In one embodiment, when the installation bracket 20 is of a structure of one square encircled by another bigger one, the third intake ports may be arranged at the edge positions on both sides of the installation bottom plate 22; and when the installation bracket 20 is of an F-shaped structure, the third intake ports may be arranged at the edge positions on both sides of the first inclined surface 321 of the fan housing 32. In the above arrangement, corresponding fan structures may each be further added at the third intake ports to ensure the intensity of gas flow.

In an example of this embodiment, the cooking device 1 further includes a first power supply line (not shown in the figure) and a second power supply line (not shown in the figure), in which the first power supply line is configured to supply power to the cabinet 10, and the cooking chamber is 111 works and cooks the food, and the second power supply line is configured to supply power to the fan assembly 30, and the oil fume generated by the stove 50 is discharged through the fan assembly 30.

In an embodiment of the present application, as shown in FIG. 1, FIG. 2 and FIG. 3, the cooking device 1 includes the cabinet 10 and the installation bracket 20, and the cabinet 10 includes the inner cavity 11 and the casing 12 sleeved outside the inner cavity 11. The casing 12 is arranged spaced apart from the inner cavity 11, to prevent the user from being scalded by the high temperature of the inner cavity 11. The cooking chamber 111 is formed inside the inner cavity 11, and a high temperature can be generated in the cooking chamber 111, and the food can be heated. The cabinet 10 further includes a door 13. The door 13 is arranged at the opening of the inner cavity 11 and is rotatably connected with the casing 12, and the cooking chamber 111 can be opened or closed through the rotation of the door 13. The installation bracket 20 is typically fixed on the wall 2 in the room and is arranged at a height from the ground. The installation bracket 20 is configured to fix the cabinet 10 of the cooking device 1. The cabinet 10 is fixed on the installation bracket 20, and a lower part of the cabinet 10 is kept at a distance from the ground, and the stove 50 can be arranged below the cabinet 10, and the oil fume generated by the stove 50 during work can be extracted and discharged by the fan assembly 30 in the cooking device 1. The installation bracket 20 is detachably connected to the cabinet 10. The installation bracket 20 includes the installation back plate 21, which is arranged opposite to the cabinet 10, and the fume exhaust duct 40 is arranged inside the installation back plate 21.

In the cooking device 1 of this embodiment, by arranging the fume exhaust duct 40 inside the installation back plate 21 and it is isolated from the various components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

With reference to FIGS. 1 to 3, in an example of this embodiment, the installation bracket 20 includes the installation back plate 21, the installation bottom plate 22 and the installation top plate 23. The installation back plate 21 is arranged opposite to the cabinet 10, and the fume exhaust duct 40 is arranged in the interior of the installation back plate 21. The installation bottom plate 22 and the installation top plate 23 are respectively connected with the bottom and the top of the installation back plate 21, and the cabinet 10 is inserted into an opening structure enclosed by the installation bottom plate 22, the installation back plate 21 and the installation top plate 23. A C-shaped opening structure arranged toward the cabinet 10 is enclosed by the installation bottom plate 22, the installation back plate 21 and the installation top plate 23, and a size of the inner cavity of the C-shaped opening structure is larger than an outer size of the cabinet 10, and the cabinet 10 can be inserted into the C-shaped opening structure. In addition to forming an installation space for accommodating the cabinet 10, the installation bottom plate 22 also can provide a supporting and fixing effect to the bottom of the cabinet 10, to further support the cabinet 10 stably. The direction of the hollow arrow in FIG. 1 is a direction in which the cabinet 10 is inserted into the installation bracket 20.

In an example of this embodiment, the fan assembly 30 and the cabinet 10 are of a split structure, in which the fan assembly 30 is arranged on the installation bracket 20 and communicates with the fume exhaust duct 40 in the installation back plate 21. As compared with the prior art in which the fan assembly 30 and the cabinet 10 are of an integral structure, in the cooking device 1 of this embodiment, the weight of the fan assembly 30 is loaded on the installation bracket 20 in advance, and the original total weight of the fan assembly 30 and the cabinet 10 are split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction.

In combination with FIG. 3 again, in an example of this embodiment, the installation back plate 21 includes the first installation back plate 211 and the second installation back plate 212 arranged opposite to each other, and the fume exhaust duct 40 is formed between the first installation back plate 211 and the second installation back plate 212, as shown in FIG. 2. The first installation back plate 211 and the second installation back plate 212 are sheet metal parts. Two sides of the first installation back plate 211 are provided with side edges extending toward the second installation back plate 212. By welding two sides of the second installation back plate 212 with the two side edges, the connection between the first installation back plate 211 and the second installation back plate 212 is realized, and a cavity is defined between the first installation back plate 211 and the second installation back plate 212 for forming the fume exhaust duct 40. By arranging the fume exhaust duct 40 in the cavity between the first installation back plate 211 and the second installation back plate 212 and it is arranged separately from the components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

Further, the second installation back plate 212 is provided with bulges 213 arranged toward the first installation back plate 211, and end faces of the bulges 213 are fitted and connected to the first installation back plate 211 for stably supporting the first installation back plate 211, and a stable double-layer structure where spacing is formed between the first installation back plate 211 and the second installation back plate 212, to define the fume exhaust duct 40. In addition, there is very little obstruction in the fume exhaust duct 40, so the fume can flow therethrough freely, and the wind resistance is small, which effectively improves the fume exhaust effect of the cooking device 1; moreover, the fume exhaust duct 40 of a double-layer structure provides the installation bracket 20 with a strong support strength. In one embodiment, the bulges 213 may be formed on the surface of the second installation back plate 212 by means of stamping.

In other examples of this embodiment, side edges may also be provided on both sides of the second installation back plate 212, and the two side edges are welded with the first installation back plate 211, or bulges 213 arranged toward the second installation back plate 212 are provided on the first installation back plate 211, both of which situations can effectively form the fume exhaust duct 40 of a double-layer structure.

With reference to FIGS. 2 and 4, in other examples of this embodiment, a duct structure may also be formed by stamping the installation back plate 21 to support the cabinet 10. The installation back plate 21 can be only one layer of sheet metal part, and ribs 214 arranged toward the cabinet 10 are formed by stamping. The ribs 214 are in close contact with a back surface of the cabinet 10, and a fume exhaust duct is formed between the cabinet 10 and the installation back plate 21. The arrangement direction of the ribs 214 defines the flow direction of gas flow in the fume exhaust duct 40. The structure in this example can also isolate the fume exhaust duct 40 from the various components in the cabinet 10, and a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

In other examples of this embodiment, in addition to the double-layer sheet metal structure and the structure formed by stamping for the fume exhaust duct 40, a pipeline made of sheet metal or plastic may also directly communicate with the fan assembly 30, to discharge the oil fume generated by the stove 50. The shape of the cross section of the pipeline may be various shapes such as square, circle or ellipse, and the specific shape is not limited.

Referring to FIGS. 1 to 3 again, in this embodiment, the fan assembly 30 of the cooking device 1 is provided above the installation back plate 21, and the fume exhaust duct 40 is an intake passage. The fan assembly 30 includes the fan body 31 and the fan housing 32, the fan body 31 is arranged inside the fan housing 32, and the fan housing 32 is provided with an installation sloping plate 322 arranged toward the cabinet 10. The cabinet 10 is provided with the inclined plate 112 arranged opposite to the installation sloping plate 322. The fan housing 32 is connected with the installation top plate 23 to fix the fan assembly 30 on the installation bracket 20. The fan body 31 communicates with the fume exhaust duct 40. The oil fume generated by the stove 50 is extracted through the fume exhaust duct 40, and is finally discharged outdoors through the pipeline. At this time, the fume exhaust duct 40 is configured to convey the oil fume to the fan assembly 30. Therefore, the fume exhaust duct 40 is the intake passage of the fan assembly 30.

It should be understood that when the user is facing the cooking device 1, a distance from the side of the cooking device 1 close to the user to the side of the cooking device 1 away from the user is a width of the cooking device 1, a distance from the user's left-hand side to the user's right-hand side is a length of the cooking device 1, and a distance from the side of the cooking device 1 close to the bottom surface to the side of the cooking device 1 away from the bottom surface is a height of the cooking device 1.

In the prior art, the fan assembly is located at the top of the inner cavity 11, and the top of the inner cavity 11 forms a rectangular space in the width direction of the cooking device 1 and the length direction of the cooking device 1. A volume of the rectangular space is much larger than that of the fan assembly. Due to the existence of the rectangular space, the size of the cooking chamber 111 in the height direction of the cooking device 1 is affected. In some examples of this embodiment, the inclined plate 112 is arranged at the corner position of the cooking chamber 111, the fan housing 32 is arranged corresponding to the inclined plate 112, and the installation sloping plate 322 arranged opposite to the inclined plate 112 is provided on the fan housing 32, and the fan housing 32 only occupies a small space in the height direction and other directions (width or length direction) of the cooking device 1 after installation. Therefore, the overall space utilization of the cooking device 1 can be improved, and the volume of the cooking chamber 111 is effectively increased, to improve the processing capability of the cooking device 1 to the food.

When the cooking device 1 needs to be installed, the fan housing 32 of the fan assembly 30 is installed on the installation top plate 23 first, and the specific connection means may be various methods such as insertion, riveting or bolt connection. After the fan assembly 30 is installed and fixed, the cabinet 10 is inserted into the C-shaped opening structure enclosed by the installation back plate 21, the installation bottom plate 22 and the installation top plate 23, and by arranging the inclined plate 112 and the installation sloping plate 322 opposite to each other, the installation strength of the cooking device 1 during installation can be effectively reduced, and the overall space utilization of the cooking device 1 is improved, and the volume of the cooking chamber 111 is effectively increased, to improve the processing capability of the cooking device 1 to the food.

As shown in FIG. 1 again, the inner cavity 11 further includes the rear side plate 113 and the top plate 114, and the top plate 114 is connected to the rear side plate 113 through the inclined plate 112. In one embodiment, the rear side plate 113 and the top plate 114 are respectively configured to form the cooking chamber 111, and the rear side plate 113 is connected to the top plate 114 through the inclined plate 112, that is, the inclined plate 112 is arranged at a corner position above the rear of the cooking chamber 111. When installing the fan assembly 30, the fan housing 32 is arranged outside the cooking chamber 111 and arranged corresponding to the inclined plate 112, that is, the fan housing 32 is installed at the corner position outside the cooking chamber 111, which further reduces the volume occupied by the fan assembly 30 during installation, and the volume of the cooking chamber 111 can be effectively increased.

It should be understood that in the present application, the rear side plate 113 and the top plate 114 are spaced apart and perpendicular to each other, and the two are connected and fixed by the inclined plate 112.

In addition, the rear side plate 113, the inclined plate 112 and the top plate 114 may be of a split structure or an integral structure. In a case where the rear side plate 113, the inclined plate 112 and the top plate 114 are of a split structure, they are processed by stamping (all the three are metal sheets), to improve the convenience of processing. In a case where the rear side plate 113, the inclined plate 112 and the top plate 114 are a split structure, they are processed and manufactured respectively, and then connected and fixed by welding or riveting. The split processing and manufacturing have a low cost, which effectively reduces the manufacturing cost of the cooking device 1.

In an example of this embodiment, the inclined plate 112 is of a flat plate structure, and a width of the flat plate structure (a distance of the inclined plate 112 between the top plate 114 and the rear side plate 113) is larger than a width of the fan assembly 30. When the fan body assembly 30 is arranged corresponding to the inclined plate 112, installation of the fan assembly 30 only affects part of the space at the top of the rear side of the cooking chamber 111, and the volume of the cooking chamber 111 is effectively increased compared with the previous case.

In other examples of this embodiment, as shown in FIG. 5, the inclined plate 112 includes the first plate body 1121 and the second plate body 1122 connected with each other at an obtuse angle. The first plate body 1121 is perpendicularly connected to the rear side plate 113 and is parallel to the top plate 114. The second plate body 1122 is connected to the top plate 114. In one embodiment, the first plate body 1121 and the second plate body 1122 are connected to each other, in which the first plate body 1121 is perpendicularly connected to the rear side plate 113, and the second plate body 1122 is connected to the top plate 114. The fan assembly 30 corresponds to the position of the inclined plate 112. An included angle between the first plate body 1121 and the second plate body 1122 is set to an obtuse angle (at the connection position outside the cooking chamber 111), and the shape between the first plate body 1121 and the second plate body 1122 better fits the fan assembly 30, which can further reduce the space occupied by the fan assembly 30 during installation, and the overall space utilization of the cooking device 1 is effectively improved.

In other examples of this embodiment, the inclined plate 112 may also be an arc-shaped plate, and the shape of the arc-shaped plate is adapted to the shape of the fan assembly 30, and the waste of space can be further reduced and the space utilization of the cooking device 1 can be further improved. As such, the volume of the cooking chamber 111 can be effectively increased, and the processing capability to the food is effectively improved.

In other examples of this embodiment, the fan assembly 30 and the cabinet 10 may also be of an integral structure, and the fan assembly 30 and the cabinet 10 are jointly inserted into the C-shaped structure of the installation bracket 20.

With reference to FIGS. 2, 4, 6 and 7, in an example of this embodiment, the bottom of the installation bracket 20 is provided with second intake ports 221, and the second intake ports 221 communicate with the fume exhaust duct 40, and the installation bracket 20 forms a C-shaped duct structure as a whole. The oil fume generated when the stove 50 is working can enter the fume exhaust duct 40 through the second intake ports 221 on both sides of the bottom of the installation bracket 20, and finally can be discharged outdoors through the extraction effect of the fan assembly 30. The second intake ports 221 adopt a fume collecting cavity structure of the shape of a bell mouth, to effectively prevent the oil fume from overflowing the second intake ports 221 during the extraction process, strengthen the effect of collecting fume and discharging fume, and realize the purpose of rapid fume discharge. In one embodiment, the second intake ports 221 can be obtained by implementing a stamping technique on the installation bottom plate 22, and the fume collecting cavity structure after stamping also improves the mechanical strength of the installation bottom plate 22. The direction of the arc-shaped arrow in FIG. 5 represents the discharge direction of the oil fume generated by the stove 50.

As shown in FIG. 8 and FIG. 9, in an example of this embodiment, the bottom of the installation bracket 20 is further provided with a flow guide plate 222. By adding a movably connected flow guide plate 222 at the second intake ports 221 of the installation bottom plate 22, the effect of discharging the oil fume of the cooking device 1 can be further improved. The flow guide plate 222 is arranged along the length direction of the installation bottom plate 22, and both ends of the flow guide plate 222 in the length direction are connected to both sides of the installation bottom plate 22 in a rotatable manner, and a turning direction of the flow guide plate 222 can be adjusted. The oil fume generated when the stove 50 is working is unstable in the flow state and the flow direction in the horizontal direction is uncertain, so it is easy for the oil fume to escape to other places in the kitchen. In order to prevent the oil fume from escaping, it is necessary to open the fan assembly 30 and the second intake ports 221, to suck the oil fume generated by the stove 50 into the fume exhaust passage 40 and finally discharge it outdoors. When the stove 50 is not working, it is not necessary to open the flow guide plate 222 to guide the oil fume generated by the stove 50, and the flow guide plate 222 is accommodated at the bottom of the installation bottom plate 22, to reduce the space occupation and maintaining a beautiful appearance. When the stove 50 works and generates the oil fume, a turning angle of the flow guide plate 222 is adjusted according to the magnitude of the flow rate of the oil fume, to change a shielding area of the flow guide plate 222 on the second intake ports 221 and the flow direction of the oil fume, to guide the oil fume to come into the second intake ports 221 and finally be discharged through the fume exhaust duct 40, which improves the discharge process of the oil fume.

In other examples of this embodiment, the fume exhaust duct 40 may also be arranged inside the cabinet 10, and the fan assembly 30 communicates with the fume exhaust duct 40 inside the cabinet 10. The oil fume generated by the stove 50 can be extracted into the fume exhaust duct 40 in the cabinet 10 under the action of the fan assembly 30, and by providing a pipeline above the cabinet 10 for communicating with the fume exhaust duct 40, the oil fume is finally discharged outdoors.

In other examples of this embodiment, as shown in FIG. 10 and FIG. 11, the fan assembly 30 and the cabinet 10 are arranged separately, the fan assembly 30 is arranged below the installation back plate 21, and the fume exhaust duct 40 is connected to the exhaust port of the fan assembly 30 to serve as the exhaust passage, and the installation bracket 20 forms an F-shaped duct structure as a whole. By placing the fan assembly 30 below the installation back plate 21, the weight of the fan assembly 30 is loaded on the installation bracket 20 in advance, and the original total weight of the fan assembly 30 and the cabinet 10 is split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction. Since the fan housing 32 is provided with the first intake port for extracting the oil fume in this example, the structure of the installation bottom plate 22 and the second intake ports 221 can be correspondingly reduced.

At the same time, by placing the fan assembly 30 below the installation bracket 20, the space occupation of the fan assembly 30 in the installation bracket 20 can be further reduced, to correspondingly enlarge the volume of the cooking chamber 111 in the cabinet 10, increasing the food storage space of the cooking chamber 111, and further improving the cooking efficiency of the cooking device 1. In addition, the space between the installation bracket 20 and the stove 50 can also be effectively utilized, to improve the space utilization.

In an example of this embodiment, the fan housing 32 is connected to the bottom surface of the installation bottom plate 22, the bottom of the fan housing 32 is provided with the first inclined surface 321 arranged toward the stove 50, and the first inclined surface 321 is provided with the first intake port (not shown in the figure). The fan assembly 30 is arranged closer to the stove 50, and the oil fume generated by the stove 50 can, before being diffused, directly enter the fume exhaust passage 40 through the first intake port under the extraction action of the fan assembly 30, and is finally discharged outdoors. Since the fan housing 32 is provided with the first intake port for extracting the oil fume, the structure of the installation bottom plate 22 and the second intake ports 221 on the installation bottom plate 22 can be correspondingly eliminated.

In other examples of this embodiment, as shown in FIG. 11 and FIG. 15, the fan assembly 30 is connected to the cabinet 10 and arranged below the installation back plate 21, and the fan assembly 30 and the cabinet 10 are of an integral structure. During installation, the cabinet 10 is connected to the installation back plate 21, and the fan assembly 30 is naturally located below the cabinet 10, which can also effectively utilize the installation space between the installation bracket 20 and the stove 50 and improve the space utilization. At the same time, the space occupation of the fan assembly 30 in the installation bracket 20 is reduced, to correspondingly enlarge the volume of the cooking chamber 111 in the cabinet 10, increasing the food storage space of the cooking chamber 111, and further improving the cooking efficiency of the cooking device 1.

In an example of this embodiment, by arranging the fume exhaust duct 40 in the installation bracket 20 and it is isolated from the various components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

In other examples of this embodiment, third intake ports (not shown in the figure) may also be provided at edges positions on both sides of the bottom of the installation bracket 20, and the third intake ports communicate with the fume exhaust duct 40 in the installation bracket 20, and when the fan assembly 30 is working, a gas flow system similar to a wind curtain is formed below the installation bracket 20 through the third intake ports on both sides of the installation bottom plate 22, to effectively prevent the oil fume generated by the stove 50 from spreading all around and ensuring the fume exhaust effect of the cooking device 1.

In one embodiment, when the installation bracket 20 is of a C-shaped structure, the third intake ports may be arranged at the edge positions on both sides of the installation bottom plate 22; and when the installation bracket 20 is of an F-shaped structure, the third intake ports may be arranged at the edge positions on both sides of the first inclined surface 321 of the fan housing 32. In the above arrangement, corresponding fan structures may each be further added at the third intake ports to ensure the intensity of gas flow.

Further, in other examples of this embodiment, each installation surface inside the installation bracket 20 is substantially planar, and there is a smooth transition between the installation surfaces, and when the cabinet 10 is not installed inside the installation bracket 20, the installation bracket can be used as a storage device, to improve the utilization efficiency of the installation bracket 20.

The cooking device 1 of this embodiment further includes a first power supply line (not shown in the figure) and a second power supply line (not shown in the figure), in which the first power supply line is configured to supply power to the cabinet 10, and the cooking chamber is 111 works and cooks the food, and the second power supply line is configured to supply power to the fan assembly 30, and the oil fume generated by the stove 50 is discharged through the fan assembly 30.

In an embodiment of the present application, as shown in FIG. 12 to FIG. 14, the cooking device 1 includes the cabinet 10, the fan assembly 30 and the installation bracket 20. The cabinet 10 includes the inner cavity 11 and the casing 12 sleeved outside the inner cavity 11. The casing 12 is arranged spaced apart from the inner cavity 11, to prevent the user from being scalded by the high temperature of the inner cavity 11. The cooking chamber 111 is formed inside the inner cavity 11, and a high temperature can be generated in the cooking chamber 111, and the food can be heated. The cabinet 10 further includes a door 13. The door 13 is arranged at the opening of the inner cavity 11 and is rotatably connected with the casing 12, and the cooking chamber 111 can be opened or closed through the rotation of the door 13.

In an example of this embodiment, the installation bracket 20 is typically fixed on the wall 2 in the room and is arranged at a height from the ground. The installation bracket 20 is configured to fix the cabinet 10 of the cooking device 1. The cabinet 10 is fixed on the installation bracket 20, and a lower part of the cabinet 10 is kept at a distance from the ground, and the stove 50 can be arranged below the cabinet 10, and the oil fume generated by the stove 50 during work can be extracted and discharged by the fan assembly 30 in the cooking device 1. The installation bracket 20 includes the installation top plate 23, the first installation side plate 24, the installation bottom plate 22 and the second installation side plate 25 that are connected end to end in sequence. The installation top plate 23, the first installation side plate 24, the installation bottom plate 22 and the second installation side plate 25 enclose to form a structure of one square encircled by another bigger one (i.e., a space enclosed by a rectangle and another rectangle inside the rectangle), and the cabinet 10 is inserted into the structure of one square encircled by another bigger one enclosed by the installation top plate 23, the first installation side plate 24, the installation bottom plate 22 and the second installation side plate 25. The first installation side plate 24 and/or the second installation side plate 24 is provided with the fume exhaust duct 40.

In an example of this embodiment, the fan assembly 30 and the installation bracket 20 are of a split connection, in which the fan assembly 30 is arranged on the installation bracket 20 and communicates with the fume exhaust duct 40 in the first installation side plate 24 and/or the second installation side plate 24. As compared with the prior art in which the fan assembly 30 and the cabinet 10 are of an integral structure, in the cooking device 1 of this embodiment, the weight of the fan assembly 30 is loaded on the installation bracket 20 in advance, and the original total weight of the fan assembly 30 and the cabinet 10 are split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction.

At the same time, by arranging the fume exhaust duct 40 in the installation bracket 20 and the oil fume is isolated from the various components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component in the cabinet 10 is ensured, and the service life of the cooking device 1 is improved.

As shown in FIGS. 3, 12 and 13, in an example of this embodiment, the first installation back plate 24 includes a first support plate (not shown in the figure) and a second support plate (not shown in the figure) arranged opposite to each other, and a first fume exhaust duct 41 is formed between the first support plate and the second support plate. The first support plate and the second support plate are sheet metal parts. Two sides of the first support plate are provided with side edges extending toward the second support plate. By welding two sides of the second support plate with the two side edges, the connection between the first support plate and the second support plate is realized, and a cavity is defined between the first support plate and the second support plate for forming the first fume exhaust duct 41. By arranging the first fume exhaust duct 41 in the cavity between the first support plate and the second support plate and it is arranged separately from the components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

Further, the second support plate is provided with bulges (not shown in the figure) arranged toward the first support plate, and end faces of the bulges are fitted and connected to the first support plate for stably supporting the first support plate, and a stable double-layer structure where spacing is formed between the first support plate and the second support plate, to define the first fume exhaust duct 41. In addition, there is no obstruction in the first fume exhaust duct 41, so the fume can flow therethrough freely, and the wind resistance is small, which effectively improves the fume exhaust effect of the cooking device 1; moreover, the first fume exhaust duct 41 of a double-layer structure provides the installation bracket 20 with a strong support strength. In one embodiment, the bulges may be formed by means of stamping.

In other examples of this embodiment, side edges may also be provided on both sides of the second support plate, and the two side edges are welded with the first support plate, or bulges arranged toward the second support plate are provided on the first support plate, both of which situations can effectively form the first fume exhaust duct 41 of a double-layer structure.

In other examples of this embodiment, an independent duct structure may also be formed by stamping the first installation side plate 24 to support the cabinet 10. The first installation side plate 24 can be only one layer of sheet metal part, and ribs arranged toward the cabinet 10 are formed by stamping. The ribs are in close contact with a side face of the cabinet 10, and the first fume exhaust duct 41 is formed between the cabinet 10 and the first installation side plate 24. The arrangement direction of the ribs defines the flow direction of gas flow in the first fume exhaust duct 41. The structure in this example can also isolate the first fume exhaust duct 41 from the various components in the cabinet 10, and a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

In other examples of this embodiment, in addition to the double-layer sheet metal structure and the structure formed by stamping for the first fume exhaust duct 41, a pipeline made of sheet metal or plastic may also directly communicate with the fan assembly, to discharge the oil fume. The shape of the cross section of the pipeline may be various shapes such as square, circle or ellipse, and the specific shape is not limited.

In this embodiment, the structures of the second installation side plate 25 and the first installation side plate 24 may be consistent or inconsistent, and a second fume exhaust duct 42 can be formed in the second installation side plate 25.

In this example, by arranging the fume exhaust duct in the installation bracket 20 and it is arranged separately from the components in the cabinet 10, a flow resistance during the fume exhaust process can be effectively reduced, a fume exhaust speed can be increased, and the fume exhaust effect can be ensured; moreover, there will be no damage caused to various components in the cabinet 10 in the long-term fume exhaust process, a reliable operation of each component is ensured, and the service life of the cooking device 1 is improved.

As shown in FIGS. 12 to 14, the fan assembly 30 in this embodiment includes the fan body 31 and the fan housing 32, and the fan body 31 is arranged inside the fan housing 32. The fan housing 32 of this embodiment is connected to the installation top plate 23, and the fan housing 32 is also provided with the installation sloping plate 322 arranged toward the cabinet 10. The cabinet 10 is provided with the inclined plate 112 arranged opposite to the installation sloping plate 322, to increase the volume in the cooking chamber 111, which effectively improves the cooking efficiency. The first installation side plate 24 and/or the second installation side plate 25 is provided therein with the fume exhaust duct 40, to form the fume exhaust duct 40 of a shape of one square encircled by another bigger one. The fan body 31 is arranged in the fan housing 32 and communicates with the fume exhaust duct 40, and the oil fume generated by the stove 50 is discharged through the side plates of the installation bracket 20. The direction of the arrows in FIGS. 13 and 14 is the flow direction of the oil fume in the fume exhaust duct. The cooking device 1 in this example can also effectively reduce the space occupation of the fan assembly 30 in the installation bracket 20, to correspondingly enlarge the volume of the cooking chamber 111 in the cabinet 10, increasing the food storage space in the cooking chamber 111, and further improving the cooking efficiency of the cooking device 1.

When the cooking device 1 needs to be installed, the fan assembly 30 is installed on the installation top plate 23 first, and the specific connection means may be various methods such as insertion, riveting or bolt connection. After the fan assembly 30 is installed and fixed, the cabinet 10 is inserted into the structure of one square encircled by another bigger one enclosed by the installation top plate 23, the first installation side plate 24, the installation bottom plate 22 and the second installation side plate 25, and by arranging the inclined plate 112 and the installation sloping plate 322 opposite to each other, the installation strength of the cooking device 1 during installation can be effectively reduced. In the cooking device 1 in this example, the fan assembly 30 is arranged on the installation bracket 20, and the fume exhaust duct 40 communicating with the fan assembly 30 is arranged inside the installation bracket 20. As compared with the integral structure of the fan assembly and the cabinet in the prior art, in the cooking device 1 in this embodiment, the weight of the fan assembly 30 is loaded on the installation bracket 20 in advance, and the original total weight of the fan assembly 30 and the cabinet 10 are split into two parts, to relatively reduce the weight of the cabinet 10 to be installed, which makes it easy to assemble the cabinet 10 and the installation bracket 20, saves time and labor, effectively improves the installation efficiency of the cooking device 1, and improves customer satisfaction.

At the same time, the fan housing 32 is arranged to have a structure with the installation sloping plate 322, which can effectively reduce the space occupied by the fan housing 32 in the installation bracket 20 compared with the fan housing 32 with a square structure in the prior art, to increase the space occupation of the cabinet 10, further increasing the space of the cooking chamber of the cabinet 10, thus increasing the food storage space in the cooking chamber 111, and further improving the cooking efficiency of the cooking device 1.

In an example of this embodiment, as shown in FIG. 1, the inner cavity may also include the rear side plate 113 and the top plate 114, and the top plate 114 is connected to the rear side plate 113 through the inclined plate 112. In one embodiment, the rear side plate 113 and the top plate 114 are respectively configured to form the cooking chamber 111, and the rear side plate 113 is connected to the top plate 114 through the inclined plate 112, that is, the inclined plate 112 is arranged at a corner position above the rear of the cooking chamber 111. When installing the fan assembly 30, the fan housing 32 is arranged outside the cooking chamber 111 and arranged corresponding to the inclined plate 112, that is, the fan housing 32 is installed at the corner position outside the cooking chamber 111, which further reduces the volume occupied by the fan assembly 30 during installation, and the volume of the cooking chamber 111 can be effectively increased.

It should be understood that in the present application, the rear side plate 113 and the top plate 114 are spaced apart and perpendicular to each other, and the two are connected and fixed by the inclined plate 112.

In addition, the rear side plate 113, the inclined plate 112 and the top plate 114 may be of a split structure or an integral structure. In a case where the rear side plate 113, the inclined plate 112 and the top plate 114 are of a split structure, they are processed by stamping (all the three are metal sheets), to improve the convenience of processing. In a case where the rear side plate 113, the inclined plate 112 and the top plate 114 are a split structure, they are processed and manufactured respectively, and then connected and fixed by welding or riveting. The split processing and manufacturing have a low cost, which effectively reduces the manufacturing cost of the cooking device 1.

In an example of this embodiment, the inclined plate 112 is of a flat plate structure, and a width of the flat plate structure (a distance of the inclined plate 112 between the top plate 114 and the rear side plate 113) is larger than a width of the fan assembly 30. When the fan body assembly 30 is arranged corresponding to the inclined plate 112, installation of the fan assembly 30 only affects part of the space at the top of the rear side of the cooking chamber 111, and the volume of the cooking chamber 111 is effectively increased compared with the previous case.

In other examples of this embodiment, as shown in FIG. 5, the inclined plate 112 includes the first plate body 1121 and the second plate body 1122 connected with each other at an obtuse angle. The first plate body 1121 is perpendicularly connected to the rear side plate 113 and is parallel to the top plate 114. The second plate body 1122 is connected to the top plate 114. In one embodiment, the first plate body 1121 and the second plate body 1122 are connected to each other, in which the first plate body 1121 is perpendicularly connected to the rear side plate 113, and the second plate body 1122 is connected to the top plate 114. The fan assembly 30 corresponds to the position of the inclined plate 112. An included angle between the first plate body 1121 and the second plate body 1122 is set to an obtuse angle (at the connection position outside the cooking chamber 111), and the shape between the first plate body 1121 and the second plate body 1122 better fits the fan assembly 30, which can further reduce the space occupied by the fan assembly 30 during installation, and the overall space utilization of the cooking device 1 is effectively improved.

In some examples of this embodiment, the inclined plate 112 may also be an arc-shaped plate, and the shape of the arc-shaped plate is adapted to the shape of the fan assembly 30, and the waste of space can be further reduced and the space utilization of the cooking device 1 can be further improved. As such, the volume of the cooking chamber 111 can be effectively increased, and the processing capability to the food is effectively improved.

In an example of this embodiment, the fan body 31 includes the first fan 311 and the second fan 312, and the fume exhaust duct 40 includes the first fume exhaust duct 41 arranged in the first installation side plate 24 and the second fume exhaust duct 42 arranged in the second installation side plate 25. The first fan 311 communicates with the first fume exhaust duct 41, and the second fan 312 communicates with the second fume exhaust duct 42, and the first fan 311 and the second fan 312 act on the first fume exhaust duct 41 and the second fume exhaust duct 42 respectively, which ensures the conveying efficiency of the oil fume and increases the oil fume exhaust speed of the cooking device 1.

As shown in FIGS. 12 to 14 again, in an example of this embodiment, the bottom of the installation bracket 20 is provided with second intake ports 221 on both sides respectively, and the second intake ports 221 communicate with the fume exhaust duct 40, and the installation bracket 20 forms a C-shaped duct structure as a whole. The oil fume generated when the stove 50 is working can enter the fume exhaust duct 40 through the second intake ports 221 on both sides of the bottom of the installation bracket 20, and finally can be discharged outdoors through the extraction effect of the fan assembly 30. The second intake ports 221 adopt a fume collecting cavity structure of the shape of a bell mouth, to effectively prevent the oil fume from overflowing the second intake ports 221 during the extraction process, strengthen the effect of collecting fume and discharging fume, and realize the purpose of rapid fume discharge. In one embodiment, the second intake ports 221 can be obtained by implementing a stamping technique on the installation bottom plate 22, and the fume collecting cavity structure after stamping also improves the mechanical strength of the installation bottom plate 22. The direction of the arc-shaped arrow in FIG. 5 represents the discharge direction of the oil fume generated by the stove 50.

As shown in FIG. 8 and FIG. 9, in an example of this embodiment, the bottom of the installation bracket 20 is further provided with the flow guide plate 222. By adding a movably connected flow guide plate 222 at the second intake ports 221 of the installation bottom plate 22, the effect of discharging the oil fume of the cooking device 1 can be further improved. The flow guide plate 222 is arranged along the length direction of the installation bottom plate 22, and both ends of the flow guide plate 222 in the length direction are connected to both sides of the installation bottom plate 22 in a rotatable manner, and a turning direction of the flow guide plate 222 can be adjusted. The oil fume generated when the stove 50 is working is unstable in the flow state and the flow direction in the horizontal direction is uncertain, so it is easy for the oil fume to escape to other places in the kitchen. In order to prevent the oil fume from escaping, it is necessary to open the fan assembly 30 and the second intake ports 221, to suck the oil fume generated by the stove 50 into the fume exhaust passage 40 and finally discharge it outdoors. When the stove 50 is not working, it is not necessary to open the flow guide plate 222 to guide the oil fume generated by the stove 50, and the flow guide plate 222 is accommodated at the bottom of the installation bottom plate 22, to reduce the space occupation and maintaining a beautiful appearance. When the stove 50 works and generates the oil fume, a turning angle of the flow guide plate 222 is adjusted according to the magnitude of the flow rate of the oil fume, to change a shielding area of the flow guide plate 222 on the second intake ports 221 and the flow direction of the oil fume, to guide the oil fume to come into the second intake ports 221 and finally be discharged through the fume exhaust duct 40, which improves the discharge process of the oil fume.

In other examples of this embodiment, the fume exhaust duct 40 may also be arranged inside the cabinet 10, and the fan assembly 30 communicates with the fume exhaust duct 40 inside the cabinet 10. The oil fume generated by the stove 50 can be extracted into the fume exhaust duct 40 in the cabinet 10 under the action of the fan assembly 30, and by providing a pipeline above the cabinet for communicating with the fume exhaust duct 40, the oil fume is finally discharged outdoors.

In other examples of this embodiment, the fan assembly 30 may also be arranged below the structure of one square encircled by another bigger one enclosed by the installation top plate 23, the first installation side plate 24, the installation bottom plate 22 and the second installation side plate 25, that is, the fan housing 32 is connected to the bottom surface of the installation bottom plate 22, and the fan body 31 is arranged inside the fan housing 32 and communicates with the fume exhaust ducts 40 on both sides. Also, the labor intensity during the installation of the cabinet 10 can be effectively reduced, and the space between the installation bracket 20 and the stove 50 can be effectively utilized.

At the same time, by placing the fan assembly 30 below the installation bracket 20, the space occupation of the fan assembly 30 in the installation bracket 20 can be further reduced, to correspondingly enlarge the volume of the cooking chamber 111 in the cabinet 10, increasing the food storage space of the cooking chamber 111, and further improving the cooking efficiency of the cooking device 1. In addition, the space between the installation bracket 20 and the stove 50 can also be effectively utilized, to improve the space utilization.

In this example, the fan housing 32 is connected to the bottom surface of the installation bottom plate 22, the bottom of the fan housing 32 is provided with the first inclined surface 321 arranged toward the stove 50, and the first inclined surface 321 is provided with a first intake port (not shown in the figure). The fan assembly 30 is arranged closer to the stove 50, and the oil fume generated by the stove 50 can, before being diffused, directly enter the fume exhaust passage 40 through the first intake port under the extraction action of the fan assembly 30, and is finally discharged outdoors.

In other examples of this embodiment, the fan assembly 30 and the cabinet 10 may also be of an integral structure, and the fan assembly 30 and the cabinet 10 are jointly inserted into the structure of one square encircled by another bigger one enclosed by the installation top plate 23, the first installation side plate 24, the installation bottom plate 22 and the second installation side plate 25. The fan housing 32 is provided with the installation sloping plate 322 arranged toward the cabinet 10, and the cabinet 10 is provided with the inclined plate 112 arranged opposite to the installation sloping plate 322, to increase the volume in the cooking chamber 111 and effectively improving the cooking efficiency of the cooking device 1.

In other examples of this embodiment, third intake ports (not shown in the figure) may also be provided at edges positions on both sides of the bottom of the installation bracket 20, and the third intake ports communicate with the fume exhaust duct 40 in the installation bracket 20, and when the fan assembly 30 is working, a gas flow system similar to a wind curtain is formed below the installation bracket 20 through the third intake ports on both sides of the installation bottom plate 22, to effectively prevent the oil fume generated by the stove 50 from spreading all around and ensuring the fume exhaust effect of the cooking device 1.

In one embodiment, the third intake ports may be arranged at the edge positions on both sides of the installation bottom plate 22, and corresponding fan structures may each be further added at the third intake ports to ensure the intensity of gas flow.

Further, in other examples of this embodiment, each installation surface inside the installation bracket 20 is substantially planar, and there is a smooth transition between the installation surfaces, and when the cabinet 10 is not installed inside the installation bracket 20, the installation bracket can be used as a storage device, to improve the utilization efficiency of the installation bracket 20.

In an example of this embodiment, the cooking device 1 further includes a first power supply line (not shown in the figure) and a second power supply line (not shown in the figure), in which the first power supply line is configured to supply power to the cabinet 10, and the cooking chamber is 111 works and cooks the food, and the second power supply line is configured to supply power to the fan assembly 30, and the oil fume generated by the stove 50 is discharged through the fan assembly 30.

What is claimed is:

1. A cooking device, comprising:

a cabinet, in which a cooking chamber is formed; and an installation bracket detachably connected to the cabinet, a fan assembly being arranged on the installation bracket, and a fume exhaust duct that communicates with the fan assembly is arranged in the installation bracket or in the cabinet;

wherein the installation bracket comprises an installation back plate, and the installation back plate is arranged opposite to the cabinet;

wherein the installation bracket further comprises an installation bottom plate and an installation top plate, the installation bottom plate and the installation top plate are respectively connected with a bottom and a top of the installation back plate, and the cabinet is inserted into an opening structure enclosed by the installation bottom plate, the installation back plate and the installation top plate.

2. The cooking device according to claim 1, wherein the fan assembly is arranged above the installation back plate, and the fume exhaust duct is an intake passage, wherein the fan assembly comprises a fan body and a fan housing, the fan body is arranged in the fan housing, the fan housing is provided with an installation sloping plate arranged toward the cabinet, and the cabinet is provided with an inclined plate arranged opposite to the installation sloping plate.

3. The cooking device according to claim 1, wherein the fan assembly is arranged below the installation back plate, and the fume exhaust duct is an exhaust passage, wherein the fan assembly comprises a fan body and a fan housing, the fan body is arranged in the fan housing, a bottom of the fan housing is provided with a first inclined surface, and a first intake port is provided on the first inclined surface.

4. The cooking device according to claim 1, wherein the installation back plate comprises a first installation back plate and a second installation back plate arranged opposite to each other, and the fume exhaust duct is formed between the first installation back plate and the second installation back plate, wherein one of the first installation back plate and the second installation back plate is provided with at least one bulge arranged toward the other of the first installation back plate and the second installation back plate.

5. The cooking device according to claim 1, wherein the installation back plate is provided with at least one rib arranged toward the cabinet, and the fume exhaust duct is formed between the installation back plate and the cabinet.

6. The cooking device according to claim 1, wherein the installation bracket comprises an installation top plate, a first installation side plate, an installation bottom plate and a second installation side plate that are connected end to end in sequence, and the cabinet is inserted into an installation space enclosed by the installation top plate, the first installation side plate, the installation bottom plate and the second installation side plate, wherein the fume exhaust duct is provided in the first installation side plate and/or the second installation side plate, and wherein fan assembly is arranged at the top or bottom of the installation bracket, and communicates with the fume exhaust duct.

7. The cooking device according to claim 1, wherein the bottom of the installation bracket is provided with a second intake port, and the second intake port communicates with the fume exhaust duct.

8. The cooking device according to claim 7, wherein two third intake ports are provided at edge positions on both sides of the bottom of the installation bracket respectively, and the third intake ports communicate with the fume exhaust duct.

9. The cooking device according to claim 1, wherein each installation surface inside the installation bracket is substantially planar, and there is a smooth transition between the installation surfaces.

10. The cooking device according to claim 1, further comprising a first power supply line and a second power supply line, and the first power supply line and the second power supply line are respectively configured to supply power to the cabinet and the fan assembly.

11. A cooking device, comprising:

a cabinet, in which a cooking chamber is formed;

an installation bracket detachably connected to the cabinet, the installation bracket comprising an installation back plate, the installation back plate being arranged opposite to the cabinet, and an interior of the installation back plate being provided with a fume exhaust duct; and a fan assembly, which is connected to the cabinet or the installation bracket, and which communicates with the fume exhaust duct;

wherein the installation back plate comprises a first installation back plate and a second installation back plate arranged opposite to each other, and the fume exhaust duct is formed between the first installation back plate and the second installation back plate, wherein one of the first installation back plate and the second installation back plate is provided with at least one bulge arranged toward the other of the first installation back plate and the second installation back plate.

12. The cooking device according to claim 11, wherein the installation back plate is provided with at least one rib arranged toward the cabinet, and the fume exhaust duct is formed between the installation back plate and the cabinet.

13. The cooking device according to claim 11, wherein the fan assembly is arranged below the installation back plate, and the fan assembly comprises a fan body and a fan housing, and wherein the fan body is arranged in the fan housing, a bottom of the fan housing is provided with a first inclined surface, and a first intake port is provided on the first inclined surface.

14. The cooking device according to claim 11, wherein the fan assembly is arranged above the installation back plate, and the fan assembly comprises a fan body and a fan housing, and wherein the fan body is arranged inside the fan housing, the fan housing is provided with an installation sloping plate arranged toward the cabinet, and the cabinet is provided with an inclined plate arranged opposite to the installation sloping plate.

15. The cooking device according to claim 13, wherein the installation bracket further comprises an installation bottom plate, which is connected to the bottom of the installation back plate, and the installation bottom plate is provided with a second intake port that communicates with the fume exhaust duct, wherein a cross-sectional shape of the second intake port is a bell mouth shape, wherein a flow guide plate is further provided on the installation bottom plate, and the flow guide plate is rotatably arranged at the second intake port, wherein the installation bracket further comprises an installation top plate, which is connected to the top of the installation back plate, and the cabinet is inserted into an opening structure enclosed by the installation bottom plate, the installation back plate and the installation top plate.

16. A cooking device, comprising:

a cabinet, in which a cooking chamber is formed;

an installation bracket detachably connected with the cabinet; and a fan assembly, which is arranged below the cabinet or the installation bracket, a fume exhaust duct being arranged in the cabinet or in the installation bracket;

wherein the installation bracket comprises an installation back plate which is arranged opposite to the cabinet, the cabinet is connected with the installation back plate, and the fan assembly is arranged below the installation back plate or the cabinet;

wherein the installation back plate comprises a first installation back plate and a second installation back plate arranged opposite to each other, and the fume exhaust duct is formed between the first installation back plate and the second installation back plate, wherein one of the first installation back plate and the second installation back plate is provided with at least one bulge arranged toward the other of the first installation back plate and the second installation back plate.

17. The cooking device according to claim 16, wherein the fan assembly comprises a fan body and a fan housing, the fan body is arranged in the fan housing, and the fan housing is connected with the cabinet or the installation bracket; and wherein a bottom of the fan housing is provided with a first inclined surface, and the first inclined surface is provided with a first intake port that communicates with the fume exhaust duct.

18. The cooking device according to claim 16, wherein the installation back plate is provided with at least one rib arranged toward the cabinet, and the fume exhaust duct is formed between the installation back plate and the cabinet.

19. The cooking device according to claim 16, wherein the installation bracket comprises an installation top plate, a first installation side plate, an installation bottom plate and a second installation side plate that are connected end to end in sequence, the cabinet is inserted into an installation space enclosed by the installation top plate, the first installation side plate, the installation bottom plate and the second installation side plate, and the fan assembly is arranged below the installation bottom plate, wherein the fume exhaust duct is provided in the first installation side plate and/or the second installation side plate, wherein each installation surface inside the installation top plate, the first installation side plate, the installation bottom plate and the second installation side plate is substantially planar, and there is a smooth transition between the installation surfaces.

20. The cooking device according to claim 16, comprising a first power supply line and a second power supply line, and the first power supply line and the second power supply line are respectively configured to supply power to the cabinet and the fan assembly.

21. A cooking device, comprising:

a cabinet, in which a cooking chamber is formed; and an installation bracket detachably connected to the cabinet, the installation bracket comprising an installation top plate, a first installation side plate, an installation bottom plate and a second installation side plate which are connected end to end in sequence, the cabinet being inserted into an installation space enclosed by the installation top plate, the first installation side plate, the installation bottom plate and the second installation side plate, and a fume exhaust duct being arranged in the first installation side plate and/or the second installation side plate.

22. The cooking device according to claim 21, further comprising at least one fan assembly, which is arranged on the cabinet and communicates with the fume exhaust duct.

23. The cooking device according to claim 21, further comprising at least one fan assembly, which is arranged on the installation bracket and communicates with the fume exhaust duct.

24. The cooking device according to claim 23, wherein the fan assembly is arranged below the installation bracket, and the fan assembly comprises a fan body and a fan housing, and wherein the fan body is arranged inside the fan housing, a bottom of the fan housing is provided with a first inclined surface, and a first intake port is arranged on the first inclined surface.

25. The cooking device according to claim 24, wherein the fan assembly is arranged above the installation bracket, and the fan assembly comprises a fan body and a fan housing, and wherein the fan body is arranged inside the fan housing, the fan housing is provided with an installation sloping plate arranged toward the cabinet, and the cabinet is provided with an inclined plate arranged opposite to the installation sloping plate, wherein a second intake port is arranged on the installation bottom plate, and the second intake port communicates with the fume exhaust duct, wherein a cross-sectional shape of the second intake port is a bell mouth shape, wherein a flow guide plate is further provided on the installation bottom plate, and the flow guide plate is rotatably arranged at the second intake port.

26. The cooking device according to claim 25, wherein two third intake ports are provided at edge positions on both sides of the bottom of the installation bracket, and the third intake ports communicate with the fume exhaust duct.

27. The cooking device according to claim 21, wherein each installation surface inside the installation bracket is substantially planar, and there is a smooth transition between the installation surfaces.

* * * * *